US010946877B2

(12) United States Patent
Zhang et al.

(10) Patent No.: US 10,946,877 B2
(45) Date of Patent: Mar. 16, 2021

(54) MOTOR SUSPENSION ASSEMBLY

(71) Applicant: General Electric Company, Schenectady, NY (US)

(72) Inventors: Jingjun Zhang, Lawrence Park, PA (US); Adrian Gorski, Erie, PA (US); Christopher L. Sheridan, Erie, PA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 415 days.

(21) Appl. No.: 15/981,657

(22) Filed: May 16, 2018

(65) Prior Publication Data

US 2019/0001996 A1 Jan. 3, 2019

Related U.S. Application Data

(60) Provisional application No. 62/526,557, filed on Jun. 29, 2017.

(51) Int. Cl.

| | |
|---|---|
| ***B61C 3/00*** | (2006.01) |
| ***B61F 5/52*** | (2006.01) |
| ***B61C 9/50*** | (2006.01) |

(52) U.S. Cl.

CPC ..... *B61C 3/00* (2013.01); *B61C 9/50* (2013.01); *B61F 5/52* (2013.01)

(58) Field of Classification Search

CPC ..... B61C 3/00; B61C 9/50; B61F 5/52

See application file for complete search history.

(56) References Cited

U.S. PATENT DOCUMENTS

| | | | | |
|---|---|---|---|---|
| 6,079,335 | A * | 6/2000 | Polley | B60L 5/38 105/218.2 |
| 7,571,683 | B2 * | 8/2009 | Kumar | B60L 50/16 105/35 |
| 7,854,203 | B2 * | 12/2010 | Kumar | B60L 50/51 105/35 |
| 9,108,518 | B2 * | 8/2015 | Madsen | B60L 15/38 |
| 9,630,507 | B2 * | 4/2017 | Zhang | B60L 5/39 |
| 2005/0235865 | A1 * | 10/2005 | Kumar | B60L 50/51 105/61 |
| 2009/0314179 | A1 * | 12/2009 | Kumar | B60L 7/12 105/35 |
| 2014/0365046 | A1 * | 12/2014 | Madsen | B60L 15/38 701/19 |
| 2019/0001996 | A1 * | 1/2019 | Zhang | B61F 5/52 |
| 2020/0047781 | A1 * | 2/2020 | Worden | B61C 15/08 |

* cited by examiner

*Primary Examiner* — Jason C Smith

(74) *Attorney, Agent, or Firm* — Christopher R. Carroll; The Small Patent Law Group LLC

(57) ABSTRACT

A motor suspension assembly includes a frame bracket configured to be coupled with a vehicle frame having mounting locations for upper and lower suspension bars that are positioned for a direct current (DC) traction motor to rest upon the upper suspension bar and for elastic pads to be disposed between the upper and lower suspension bars. The frame bracket is configured to be coupled with the vehicle frame in place of at least one of the upper suspension bar or the lower suspension bar. The assembly also includes a dog bone suspension link configured to be coupled with a nose bracket of an alternating current (AC) traction motor and the frame bracket. The dog bone suspension link is configured to absorb vibration by at least partially rotating about one or more of the nose bracket or the frame bracket during operation of the AC traction motor.

22 Claims, 21 Drawing Sheets

MOTOR SUSPENSION ASSEMBLY

CROSS-REFERENCE TO RELATED APPLICATIONS

This application claims priority to U.S. Provisional Application No. 62/526,557, which was filed on 29 Jun. 2017, and the entire disclosure of which is incorporated herein by reference.

FIELD

The subject matter described herein relates to suspension assemblies for motors, such as electrically powered traction motors in vehicles.

BACKGROUND

Some vehicles are propelled by electrically powered traction motors. For example, some automobiles, rail vehicles, mining vehicles, and the like, can include traction motors that are powered by direct current for propelling the vehicles. The motors can be hung or connected to a frame of the vehicle. The connection of the motors to the frame can include a suspension to at least partially reduce and absorb vibrations and shocks due to travel on uneven surfaces.

The type of connection between the motors and the vehicle frames can depend on the type of motor. For example, motors powered by direct current (e.g., unidirectional current, or current that only flows in a single direction) can be connected to vehicle frames using a different type of suspension than motors powered by alternating current (e.g., current that periodically reverses direction).

Some vehicle frames may not permit for swapping out of different types of motors. For example, vehicle frames designed for connecting to direct current motors may not be shaped and/or sized to be connected with alternating current motors. As a result, some vehicles cannot be upgraded from direct current motors to alternating current motors without replacing or modifying the frames of the vehicles. The high cost of the vehicle frame can make this a cost prohibitive upgrade for the vehicle.

BRIEF DESCRIPTION

In one embodiment, a motor suspension assembly includes a frame bracket configured to be coupled with a vehicle frame having mounting locations for upper and lower suspension bars that are positioned for a direct current (DC) traction motor to rest upon the upper suspension bar and for elastic pads to be disposed between the upper and lower suspension bars. The frame bracket is configured to be coupled with the vehicle frame in place of at least one of the upper suspension bar or the lower suspension bar. The assembly also includes a frame bracket configured to be coupled with a nose bracket of an alternating current (AC) traction motor at a location of top or bottom of the exterior motor housing. The assembly also includes a dog bone suspension link, an elastic bush which is compressed between each end of the dog bone suspension link and the frame bracket at that end of the dog bone suspension link. The elastic bushes are configured to provide elastic connection between the AC motor and the vehicle frame to allow relative movement and rotation between the AC motor and the vehicle frame to reduce and absorb vibrations during operation of the vehicle and AC traction motor.

In one embodiment, a motor suspension assembly includes an upper frame bracket configured to be coupled with a vehicle frame having mounting locations for upper and lower suspension bars that are positioned for a direct current (DC) traction motor to rest upon the upper suspension bar. The upper frame bracket is configured to be coupled with the vehicle frame in place of the upper suspension bar. The assembly also includes a lower frame bracket configured to be coupled with the vehicle frame in place of the lower suspension bar, a suspension bracket configured to be coupled with a nose bracket of an alternating current (AC) traction motor, one or more upper elastic pads configured to be compressed between the upper frame bracket and the suspension bracket, and one or more lower elastic pads configured to be compressed between the lower frame bracket and the suspension bracket. The one or more upper elastic pads and the one or more lower elastic pads fill open spaces between upper frame bracket, the lower frame bracket, and the suspension bracket to reduce and absorb vibration during operation of the AC traction motor and vehicle.

In one embodiment, a method includes coupling a frame bracket with a vehicle frame in a location where an upper suspension bar or a lower suspension bar previously was coupled with the vehicle frame. The upper and lower suspension bars previously held one or more elastic pads therebetween and positioned for a DC traction motor to rest on the upper suspension bar. The method also includes coupling a frame bracket with a nose bracket of an AC traction motor. The method also includes coupling the dog bone suspension link with the frame brackets, where the pre-compressed elastic bushes between the dog bone suspension link and the frame brackets provide elastic connection to allow relative movement and rotation between the AC motor and the vehicle frame to reduce and absorb vibrations during operation of the vehicle and AC traction motor.

In one embodiment, a method includes coupling an upper frame bracket with a vehicle frame having mounting locations for upper and lower suspension bars that are positioned for a DC traction motor to rest upon the upper suspension bar. The upper frame bracket is configured to be coupled with the vehicle frame in place of the upper suspension bar. The method also includes coupling a lower frame bracket with the vehicle frame in place of the lower suspension bar, and coupling a suspension bracket with a nose bracket of an alternating current (AC) traction motor. The method also includes positioning one or more upper elastic pads between the upper frame bracket and the suspension bracket, and positioning one or more lower elastic pads between the lower frame bracket and the suspension bracket. The one or more upper elastic pads and the one or more lower elastic pads fill open spaces between upper frame bracket, the lower frame bracket, and the suspension bracket to reduce and absorb vibration during operation of the vehicle and AC traction motor.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein provide motor suspension assemblies for coupling alternating current (AC) powered traction motors with vehicle frames designed or shaped for being coupled with direct current (DC) powered traction motors. The assemblies can allow for an existing DC vehicle truck frame (of a vehicle truck or bogie, i.e., a modular subassembly of wheels and axles) to be used to support AC motors for converting or upgrading vehicles. The assemblies fit into the existing DC truck frame without any structural changes to the vehicle frame while meeting space and support requirements for AC motors. Various elastic elements (e.g., rubber pads or bushes) can be positioned to elastically suspend the motor without creating any dead zone (gap) in the stiffness characteristics of the motor suspension between the motor and the truck frame which can cause dynamic impacts and traction control issues. The assemblies can provide necessary vertical, lateral, and longitudinal stiffness as well as rotational stiffness to meet both vehicle and motor dynamics and AC traction control requirements.

Figure 1:
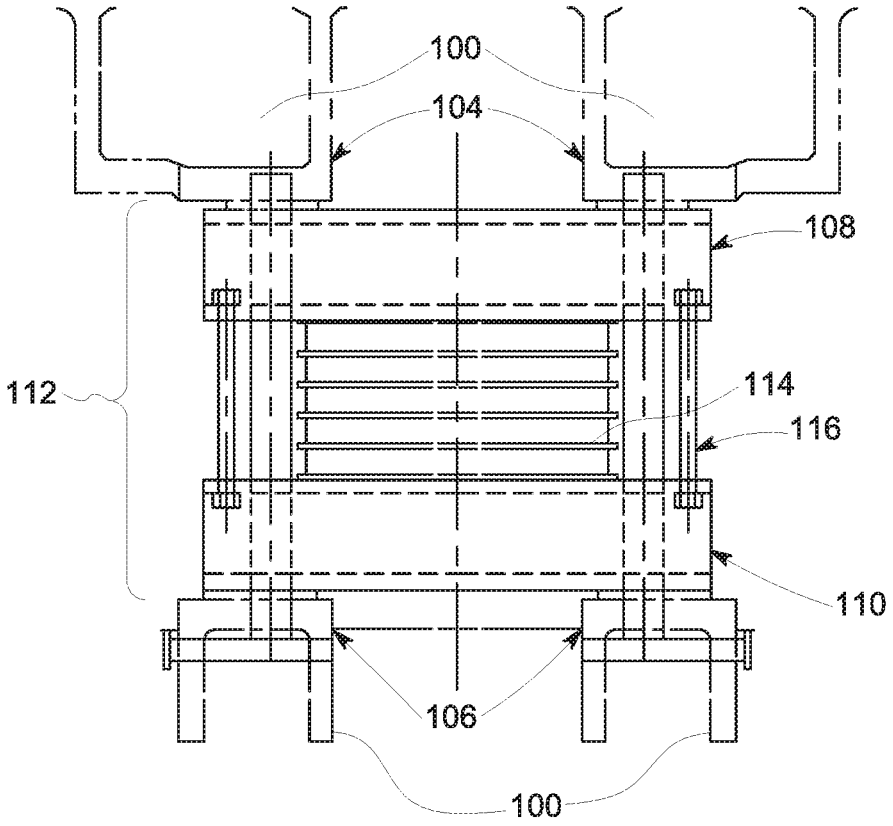
FIG. 1 illustrates a front view of one example of a vehicle frame configured to support direct current (DC) traction motors.
Figure 2:
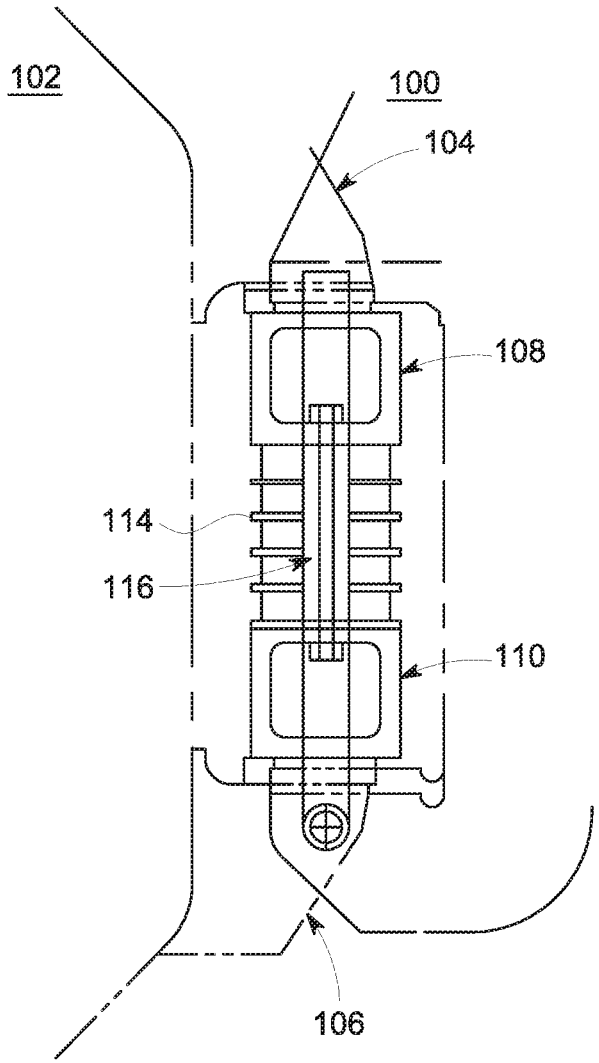
FIG. 2 illustrates a side view of one example of the vehicle frame shown in FIG. 1.

FIGS. 1 and 2 illustrate front and side views of one example of a vehicle frame 100 configured to support DC motors 102. While only one portion of a DC motor 102 is shown, the vehicle frame 100 can support multiple DC motors 102. The DC motor 102 has upper and lower nose brackets 104, 106 that project outward from the remainder of the body or outer housing of the DC motor 102. A DC motor suspension assembly 112 supports the DC motor 102 and couples the DC motor 102 to the frame 100. The assembly 112 includes upper and lower suspension bars 108, 110 that are coupled (e.g., bolted) to the vehicle frame 100 by elongated, vertically oriented rigid pins 116. Several rubber pads 114 are compressed between the upper and lower suspension bars 108, 110. The nose brackets 104, 106 of the DC motor 102 rest on or engage the upper and lower suspension bars 108, 110 of the assembly 112 during operation of the motor. This assembly 112 can result in wear on the components of both the motors and the suspension assembly.

For example, depending on the direction of the motor torque (for the vehicle to move forward or backward) during traction, either an upper nose bracket 104 of the motor 102 will contact the upper suspension bar 108 or a lower nose bracket 106 of the motor 102 will contact the lower suspension bar 110. The contact between the motor nose and the suspension bar is a metal-to-metal contact. There will be wear on both the motor nose brackets 104, 106 and the suspension bars 108, 110 due to relative motions between the motor 102 and the vehicle frame 100 in lateral, longitudinal and yaw directions.

Due to vibration and friction, the pins which couple the DC motor suspension assembly 112 to the vehicle frame (and also the related frame and bars) will be worn. This will reduce the life of the pins 116 and increase the maintenance cost. Due to an initial gap between the motor noses and the suspension bars 108, 110, and due to nose/bar wear as well as rubber pads 114 set caused by aging, there will be a gap existing between the lower motor nose bracket 106 and lower suspension bar 110. When the motor moves up and down, the gap will cause dynamic impact, which may damage components and introduce issues for traction control. For example, when the motor nose bracket 104 contacts the upper suspension bar 108 and the motor nose moves downward, the force between the nose bracket 104 and the bar 108 increases. But, when the motor nose initially moves upward from contacting the bar 108, there will be a certain distance that the nose can move before the suspension force between the lower suspension bar 110 and the lower motor nose bracket 106 begins to increase. This distance can be referred to as a dead zone or gap between the motor and the suspension assembly 112.

Figure 3:
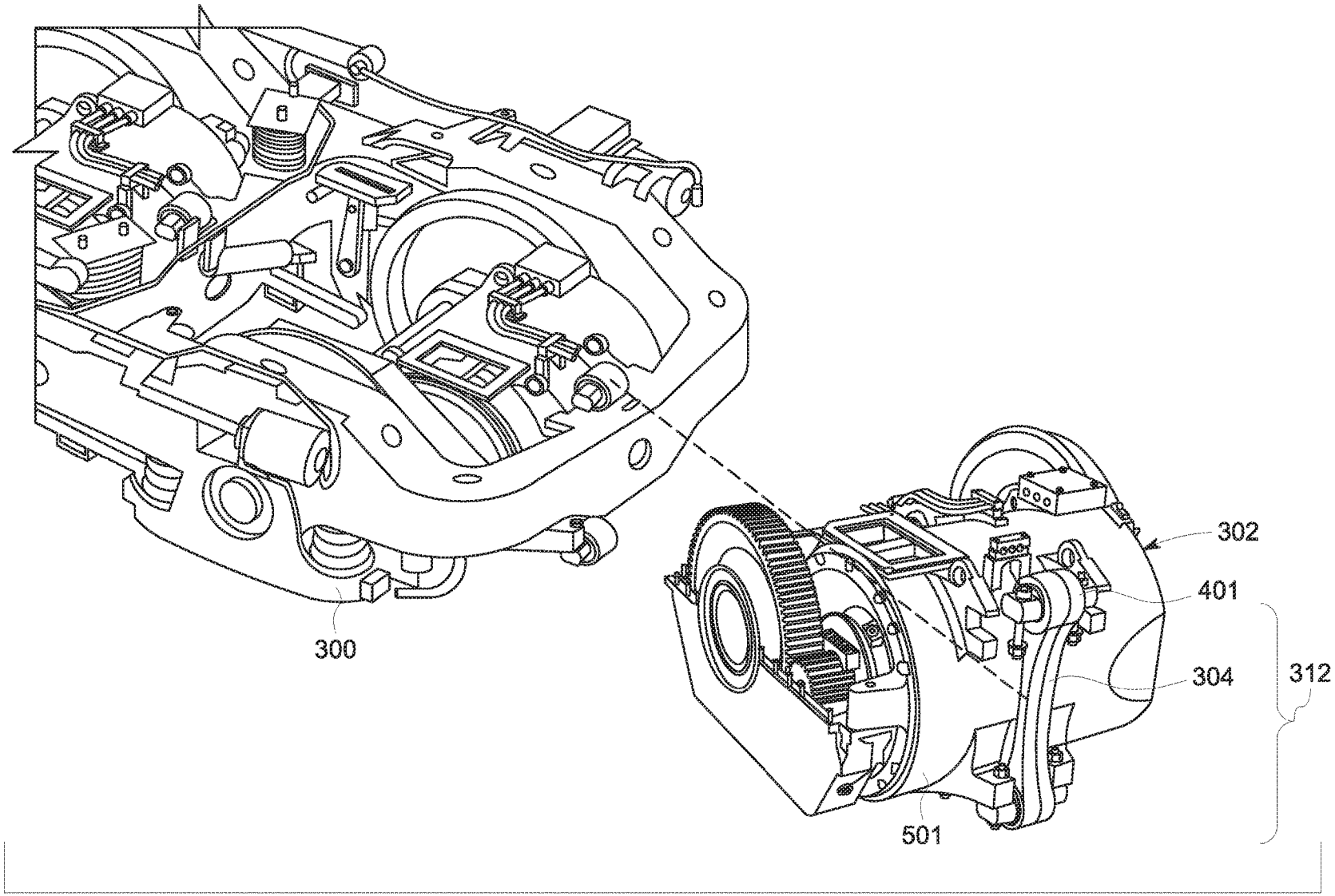
FIG. 3 illustrates another type of vehicle frame and an alternating current (AC) traction motor

The assembly 112 cannot be used to support an AC motor without changing the shape of the vehicle frame 100 due to differences in size and shape between the DC and AC motors. FIG. 3 illustrates another type of vehicle frame 300 and an AC traction motor 302. The frame 300 is designed and shaped to support the AC traction motors 302, but not DC motors 102. Similarly, the frame 100 is designed and shaped to support the DC motors 102, but not AC motors 302.

Figure 4:
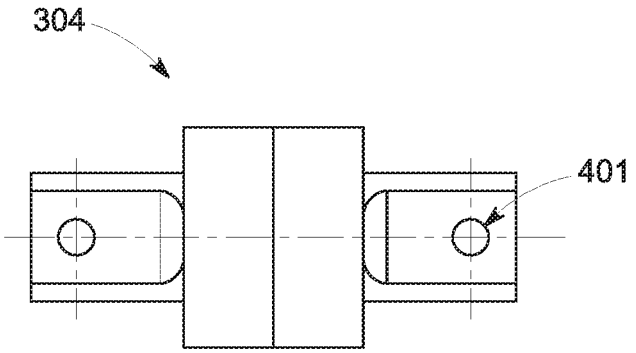
FIG. 4 illustrates a top view of a suspension link shown in FIG. 3.
Figure 5:
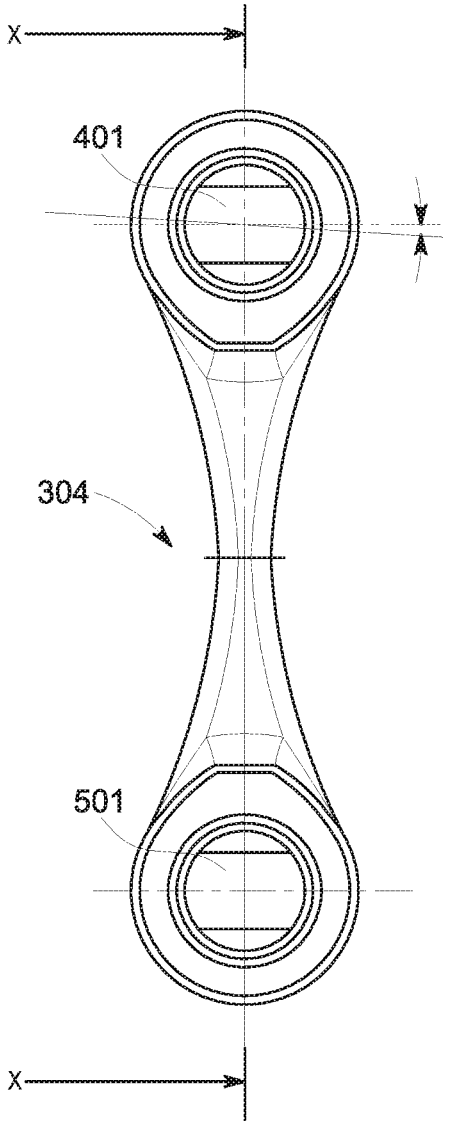
FIG. 5 illustrates a side view of the suspension link shown in FIG. 3.
Figure 6:
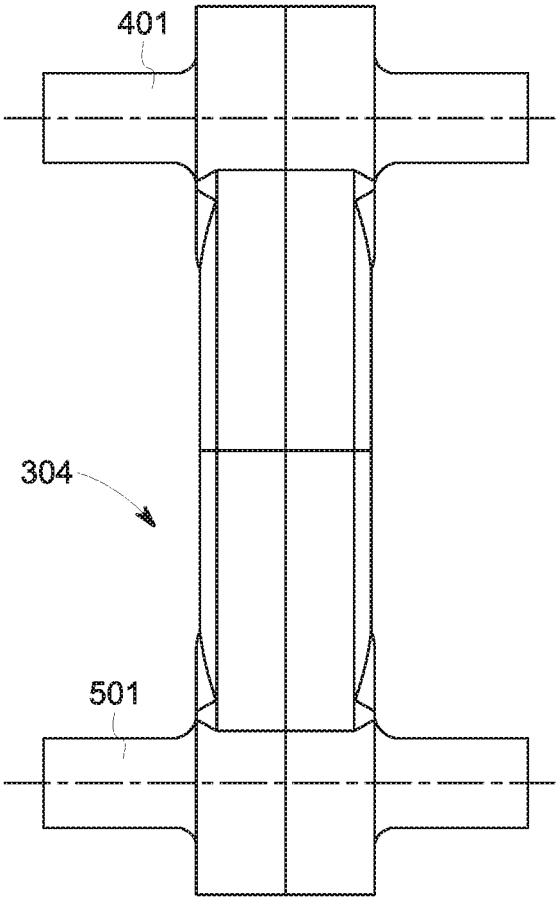
FIG. 6 illustrates a front view of the suspension link shown in FIG. 3.
Figure 7:
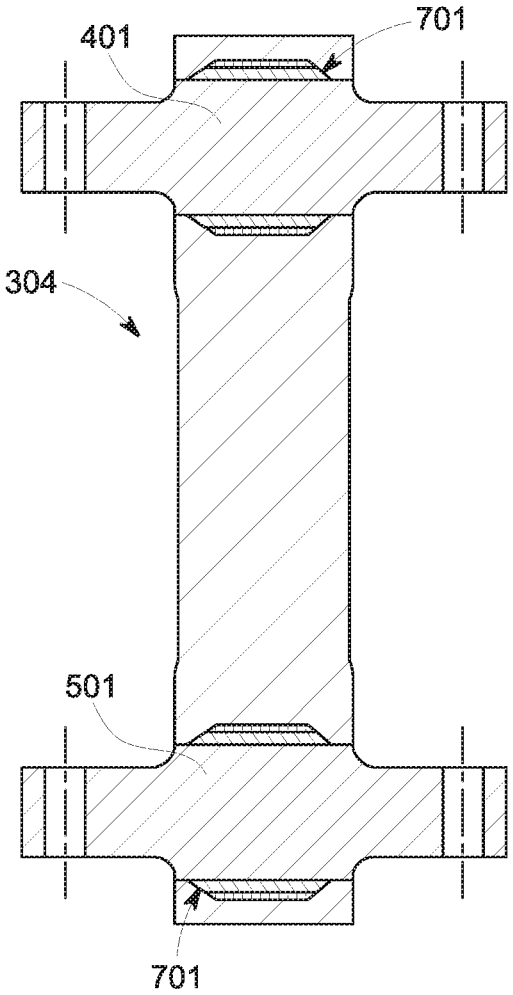
FIG. 7 illustrates a cross-sectional view of the suspension link shown in FIG. 3 along line X-X shown in FIG. 5.

The AC motor 302 is coupled with the frame 300 by a dog bone suspension assembly 312. The dog-bone suspension assembly includes a suspension link 304 and upper and lower frame brackets 401, 501 with each at one end of the link 304. The frame brackets 401, 501 are coupled with or part of the frame 300 of the vehicle. With continued reference to the frame 300 and motor 302 shown in FIG. 3, FIG. 4 illustrates a top view of the suspension link 304 shown in FIG. 3, FIG. 5 illustrates a side view of the suspension link 304 shown in FIG. 3, FIG. 6 illustrates a front view of the suspension link 304 shown in FIG. 3, and FIG. 7 illustrates a cross-sectional view of the suspension link shown in FIG. 3 along line X-X shown in FIG. 5. The suspension link 304 is coupled with the upper and lower frame brackets 401, 501. Elastic bushes or bushings 701 are disposed between the elongated link body 304 and the frame brackets 401, 501 to absorb or reduce vibrations.

The dog bone suspension link 304 is coupled with an outer housing bracket of the AC motor 302 at one end of the dog bone suspension link 304 by the frame bracket 401. An opposite end of the dog bone suspension link 304 is coupled with the frame 300 by the lower frame bracket 501. The elastic bushes 701 are compressed between the suspension link 304 and the frame brackets 401, 501. The ends of the dog bone suspension link 304 can move and rotate relative to the frame brackets 401, 501 which are coupled with the motor housing bracket 308 and the frame 300 to reduce and absorb vibrations of the vehicle and AC motor 302 during operation.

The assemblies and methods described herein allow for the vehicle frame 100 that is designed for supporting DC motors 102 to support AC motors without modifying the vehicle frame 100 by cutting away or removing portions of the vehicle frame 100.

Figure 8:
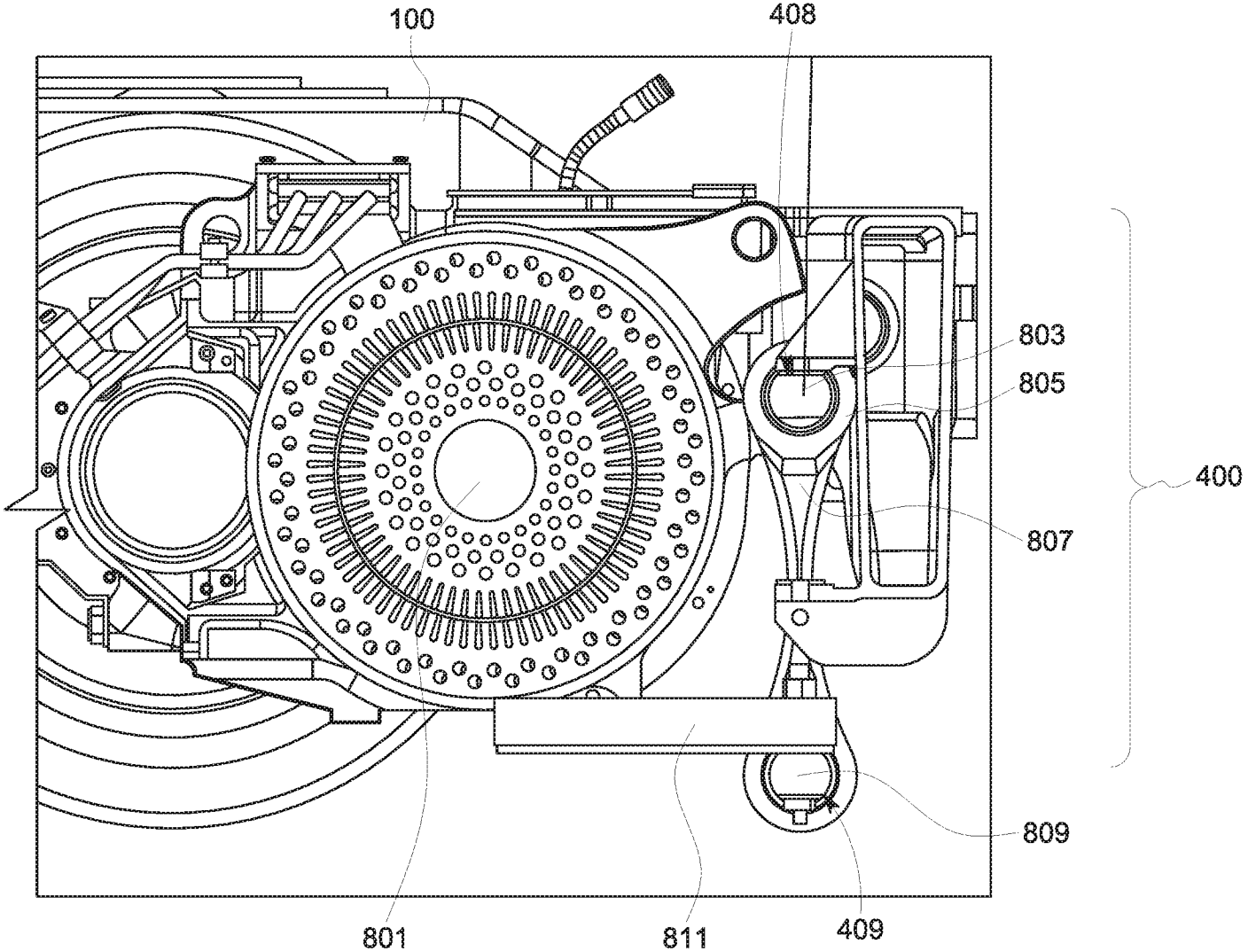
FIG. 8 illustrates one example of a motor suspension assembly.
Figure 9:
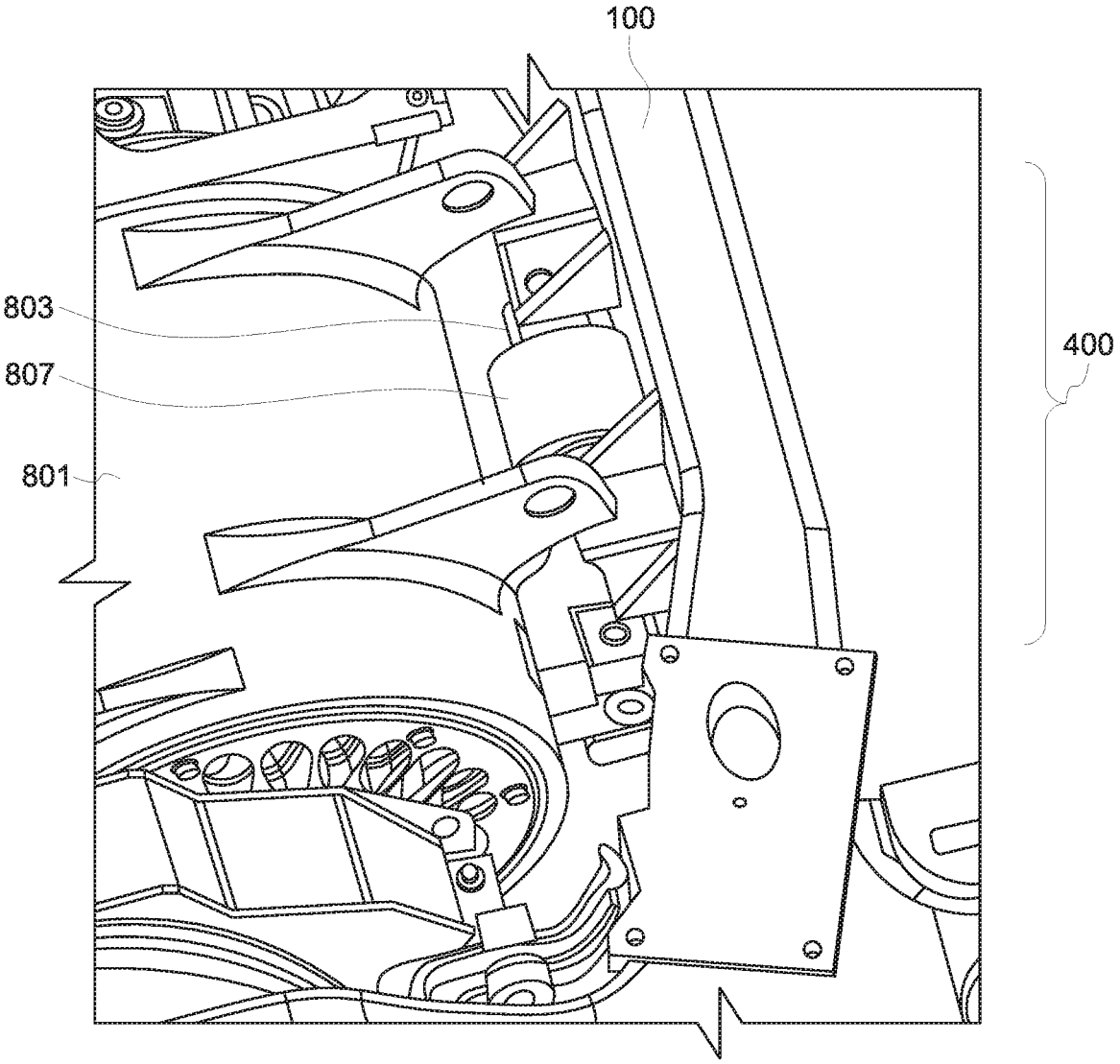
FIG. 9 also illustrates the motor suspension assembly shown in FIG. 8.
Figure 10:
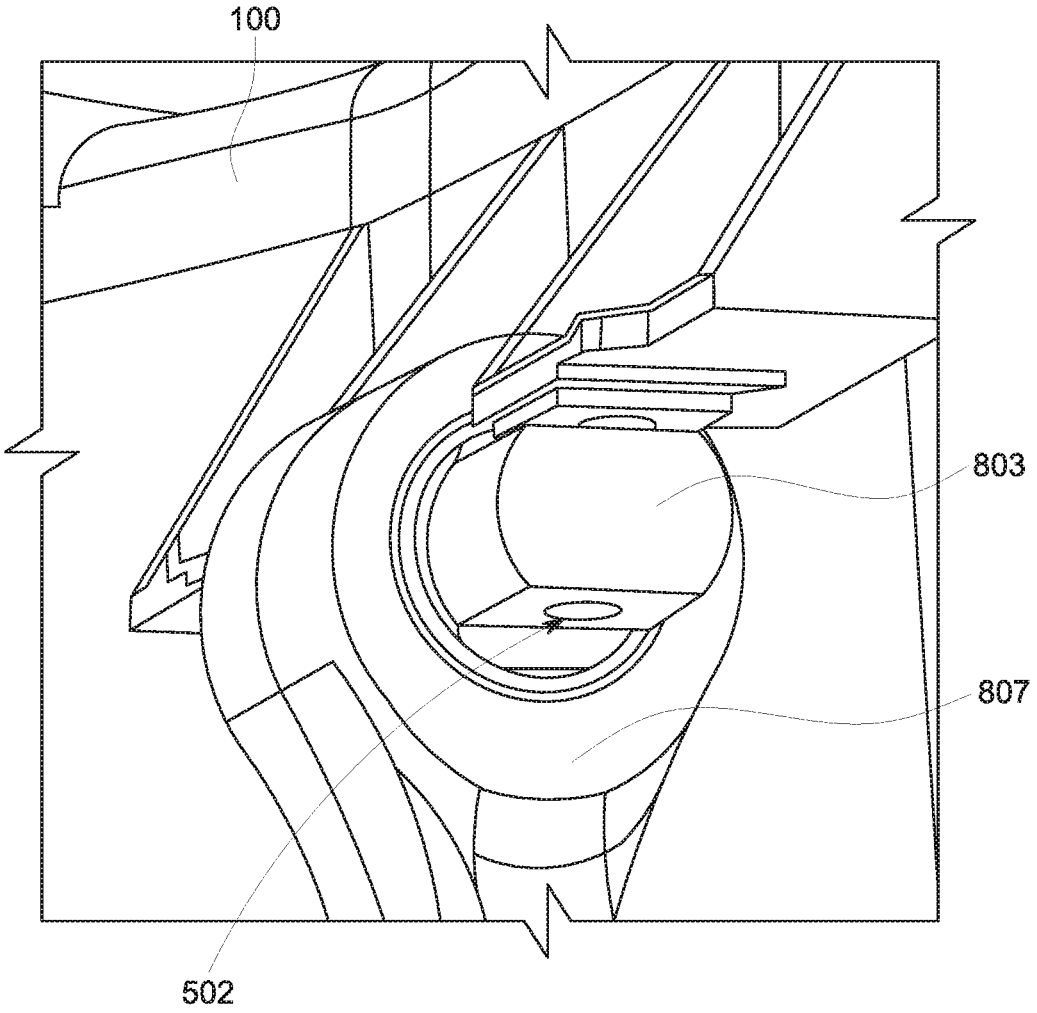
FIG. 10 also illustrates the motor suspension assembly shown in FIG. 8.

FIGS. 8 through 10 illustrate one example of a motor suspension assembly 400. The assembly 400 adapts the vehicle frame 100 designed for coupling with the DC motor 102 to couple with and support an AC motor 801. This can allow for a vehicle having the frame 100 to be retrofitted with the AC motor. The assembly 400 includes an upper frame bracket 803 that is connected with the vehicle frame 100. An upper end 805 of a dog bone suspension link 807 can be coupled with the upper frame bracket 803 by pre-compressed elastic bush or bushings 701. The suspension link 807 can be different from the suspension link 304 in that the suspension link 807 may have holes (for receiving the upper and lower frame brackets) in different locations than the suspension link 304, the suspension link 807 may be a different length and/or be a different size than the suspension link 304, and/or the bushings in the suspension link 807 may have a different stiffness than the bushings in the suspension link 304.

The upper frame bracket 803 can be inserted through an upper opening or channel 408 in the upper end of the dog bone suspension link 807 such that the dog bone suspension link 807 can at least move and rotate relative to the upper frame bracket 803 by using the elastic bush 701. The upper frame bracket 803 can be elongated in lateral directions. The upper frame bracket 803 is bolted to the frame 100 and a lower frame bracket 809 is bolted to a nose bracket 811 of the motor. This nose bracket 811 can be an elongated linear or planar extension of the housing of the AC motor or can be an elongated linear or planar extension that is added to the housing of the AC motor (e.g., by bolting or welding the extension onto the housing). The upper frame bracket 803 can include holes or channels 502 (shown in FIG. 10). These holes or channels 502 can receive bolts, screws, pins, or the like, for securely coupling the upper frame bracket 803 to the vehicle frame 100. The upper frame bracket 803 is coupled with the vehicle frame 100 in the same mounting location that the upper suspension bar 108 (shown in FIG. 1) previously was coupled with the vehicle frame 100. For example, the DC motor suspension assembly 112 that was supporting the DC motor 102 (shown in FIG. 1) can be removed from the vehicle frame 100. The upper frame bracket 803 of the dog-bone suspension assembly 400 can be installed and secured (e.g., bolted) to the same locations where the DC motor suspension assembly 112 was previously secured by the pin 116 to the vehicle frame 100.

The bracket 811 can be referred to as a nose bracket, and can include plural parallel elongated arms that project from the outer housing of the AC motor. These arms project toward the vehicle frame 100 and the dog bone suspension link 807 in the assembled state of the suspension assembly 400. The arms are coupled with the lower frame bracket 809 that may be identical to or similar to the upper frame bracket 803 that is coupled with the vehicle frame 100. For example, bolts, screws, pins, or other fasteners can be placed through the openings 502 in the lower frame bracket 809 and secured to the arms of the nose bracket 811. The lower frame bracket 809 that is coupled with the arms of the nose bracket 811 can be coupled with the lower end of the dog bone suspension link 807 by a pre-compressed elastic bush, such as the bush 701. The lower frame bracket 809 can be located in a lower opening or channel 409 that extends through the lower end of the elongated body of the dog bone suspension link 807.

The upper and lower frame brackets 803, 809 and the nose bracket 811 connect the AC motor with the vehicle frame 100 such that the AC motor is suspended to the vehicle frame 100 without removing parts of or otherwise changing the shape or layout of the vehicle frame 100. The frame brackets 803, 809 (which are part of the dog-bone suspension 400) and the nose bracket 811 which is part of the AC motor allow the dog bone suspension link 807 to couple the AC motor with the vehicle frame 100 that was designed and shaped for the DC motor. The elastic bushes 701 at the ends of the dog bone suspension link 807 (e.g., between the inner surface of the openings 408, 409 in the opposite ends of the elongated body of the link 807 and the brackets 803, 809) can allow the motor to move and rotate relative to the vehicle frame 100 and provide the suspension stiffness to reduce and absorb vibrations generated during operation of the vehicle and the AC motor. The AC motor also can be connected with an axle of the vehicle directly or via one or more gears. The AC motor may not have any other connection or coupling with the vehicle frame 100 (aside from the assembly 400) in one embodiment.

Figure 11:
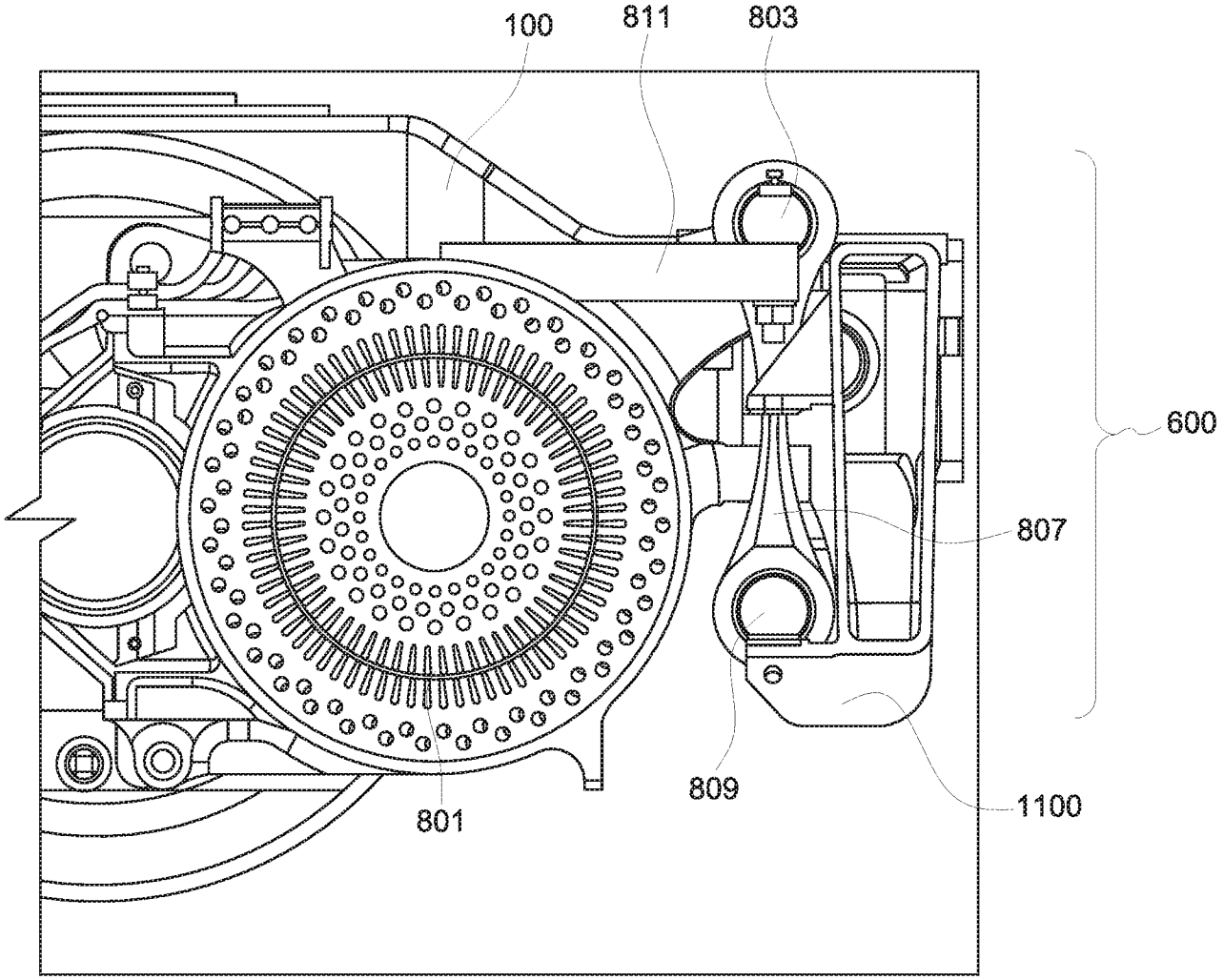
FIG. 11 also illustrates another example of a motor suspension assembly.
Figure 12:
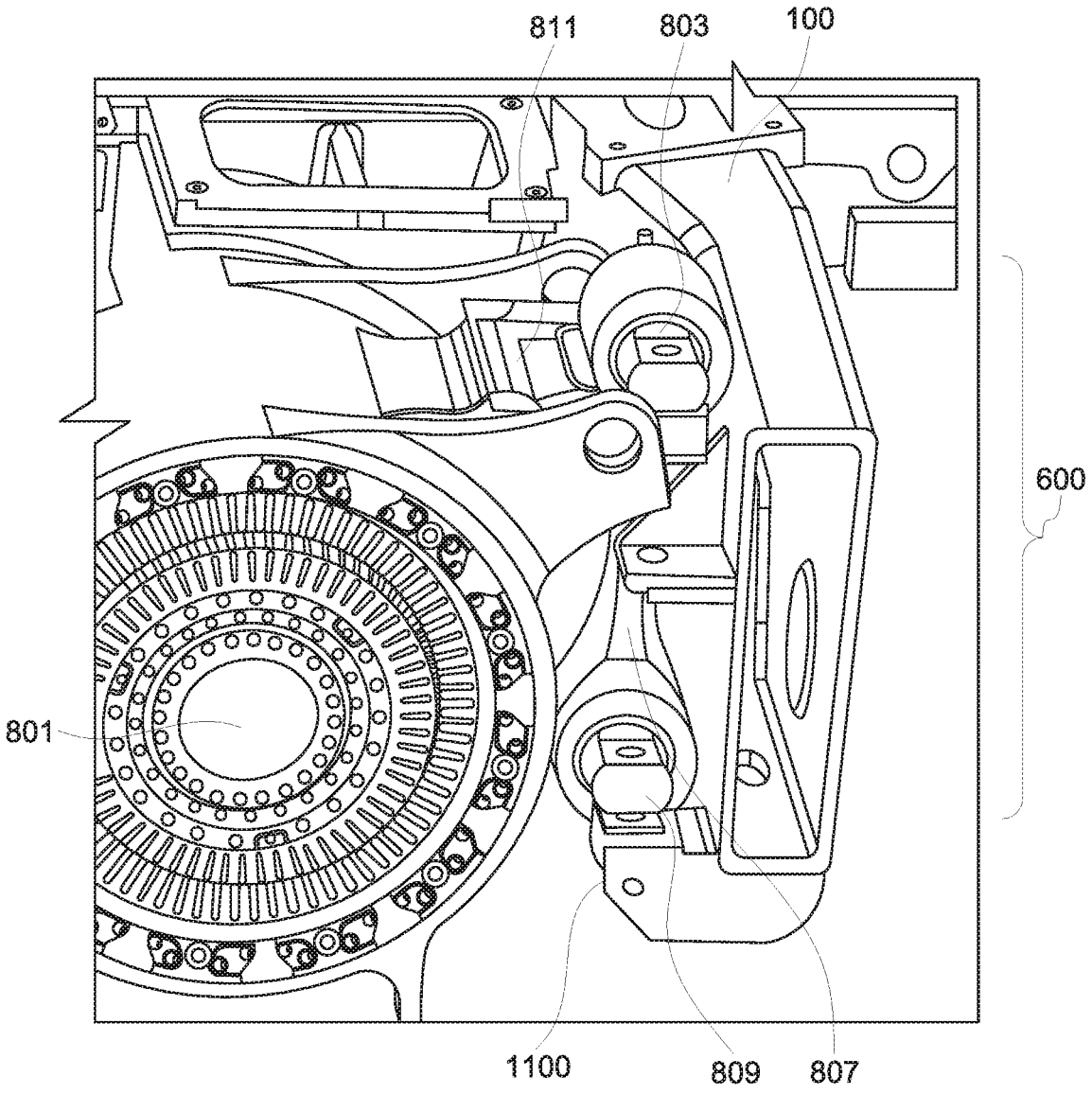
FIG. 12 also illustrates the motor suspension assembly shown in FIG. 11.
Figure 13:
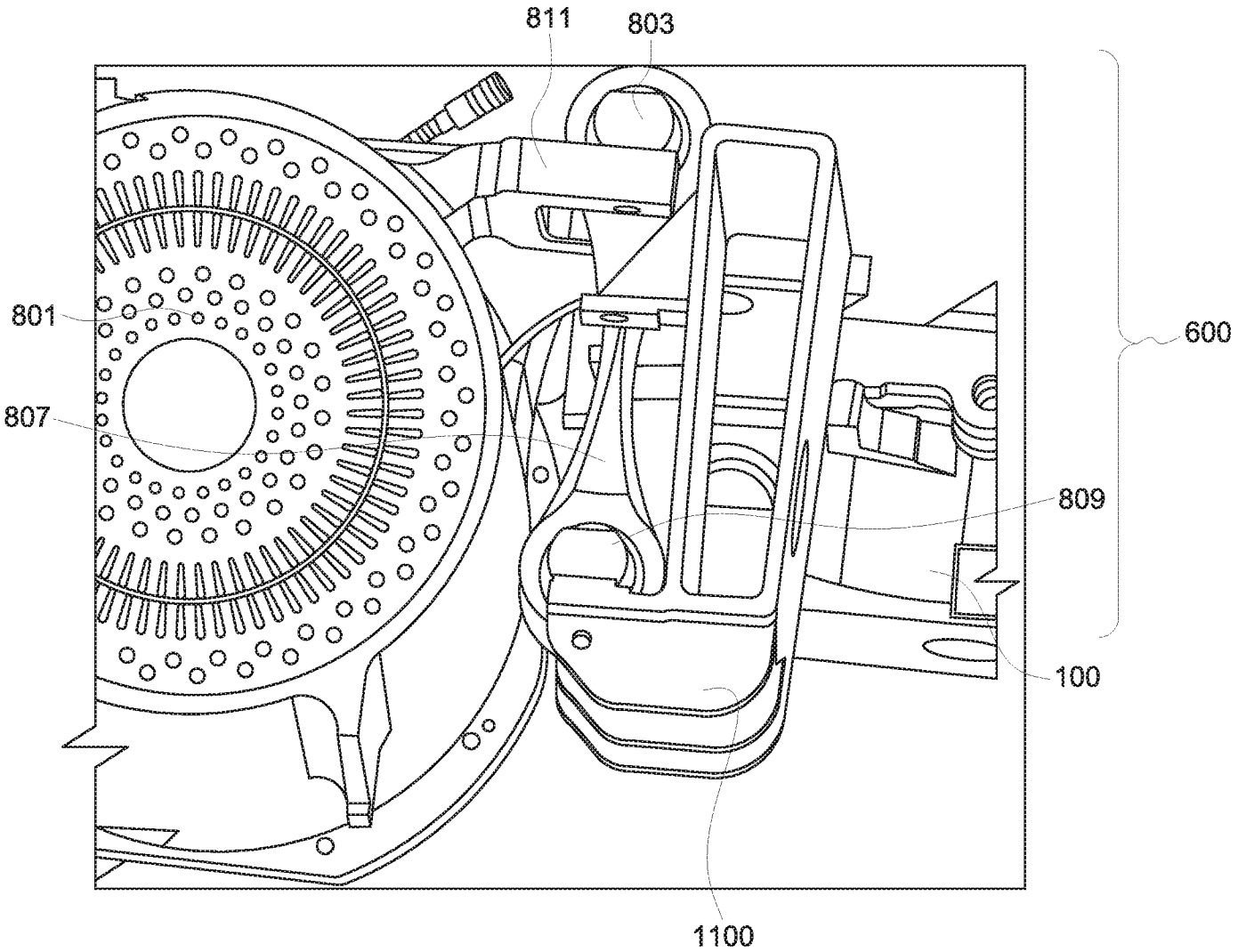
FIG. 13 also illustrates the motor suspension assembly shown in FIG. 11.

FIGS. 11 through 13 illustrate another example of a motor suspension assembly 600. The assembly 600 is similar to the assembly 400 shown in FIGS. 8 through 10 in that the assembly 600 includes the dog bone suspension link 807 (with the upper and lower frame brackets 803, 809) and the nose bracket 811 to couple the AC motor 801 to the vehicle frame 100 designed for DC motors 102 using the dog bone suspension link 807. The shape and/or size of the link 807 and nose bracket 811 and location in the assembly 600 may differ from the shape and/or size of the link 807 and nose bracket 811 and location in the assembly 400.

One difference between the assemblies 400, 600 is the locations and orientations of the nose bracket 811 and the corresponding frame brackets 803, 809. Another difference is the location on the vehicle frame 100 where the dog bone suspension link 807 is coupled with the frame 100. For example, the upper frame bracket 803 of the link 807 can be coupled with the nose bracket 811 of the AC motor.

The lower frame bracket bar 809 of the link 807 is coupled with a lower bracket 1100 of the vehicle frame 100 in the assembly 600. The AC motor 801 is coupled with the frame 100 by the assembly 600 in an inverted position or orientation relative to how the AC motor is coupled with the frame 100 by the assembly 400.

The lower frame bracket 809 can be connected with the frame 100 in the same location as the lower suspension bar 110 previously was coupled. The nose bracket 811, however, is now added to the upper outer housing of the AC motor 801, in contrast to the nose bracket 811 being coupled with the lower outer housing of the AC motor 801 in the assembly 400.

The AC motor 801 can be coupled with an axle of the vehicle that includes the frame 100, and the assembly 600 can reduce and absorb vibrations during operation of the vehicle and AC motor 801, similar to as described above in connection with the assembly 400. The AC motor 801 may not be coupled with the frame 100 in another location in one embodiment.

Figure 14:
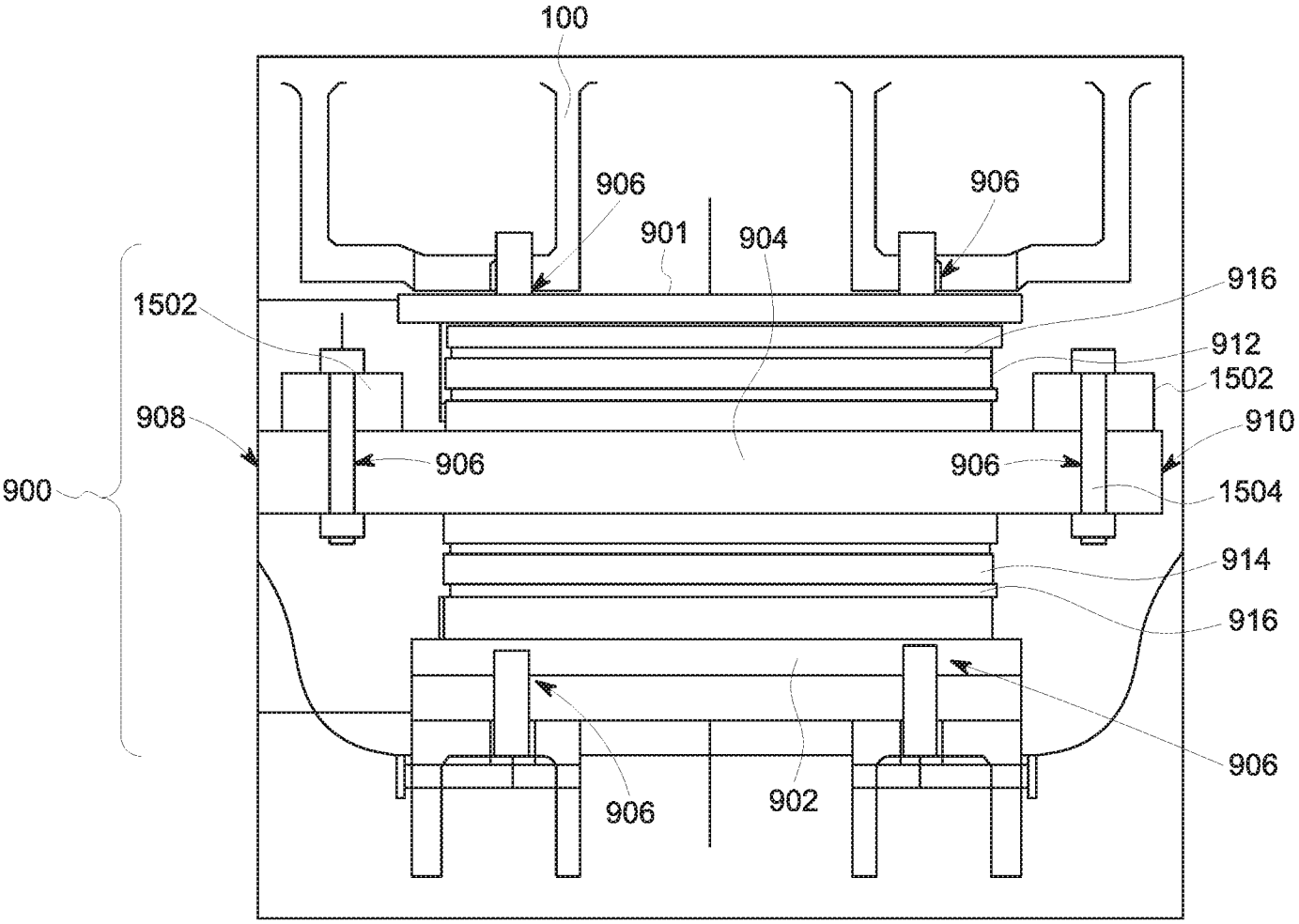
FIG. 14 illustrates a front view of another example of a motor suspension assembly.
Figure 15:
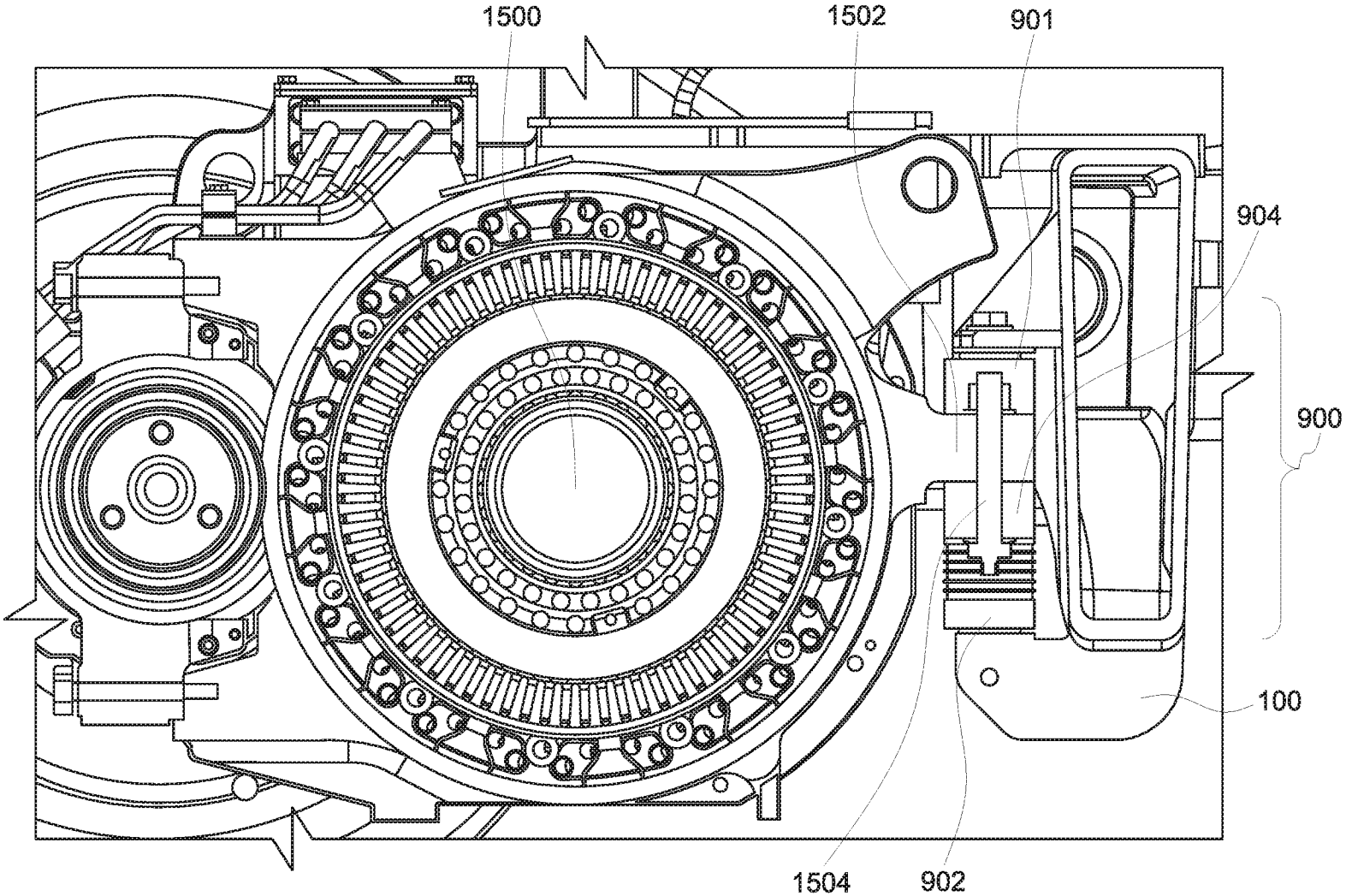
FIG. 15 illustrates a cross-sectional view of the assembly shown in FIG. 14.
Figure 16:
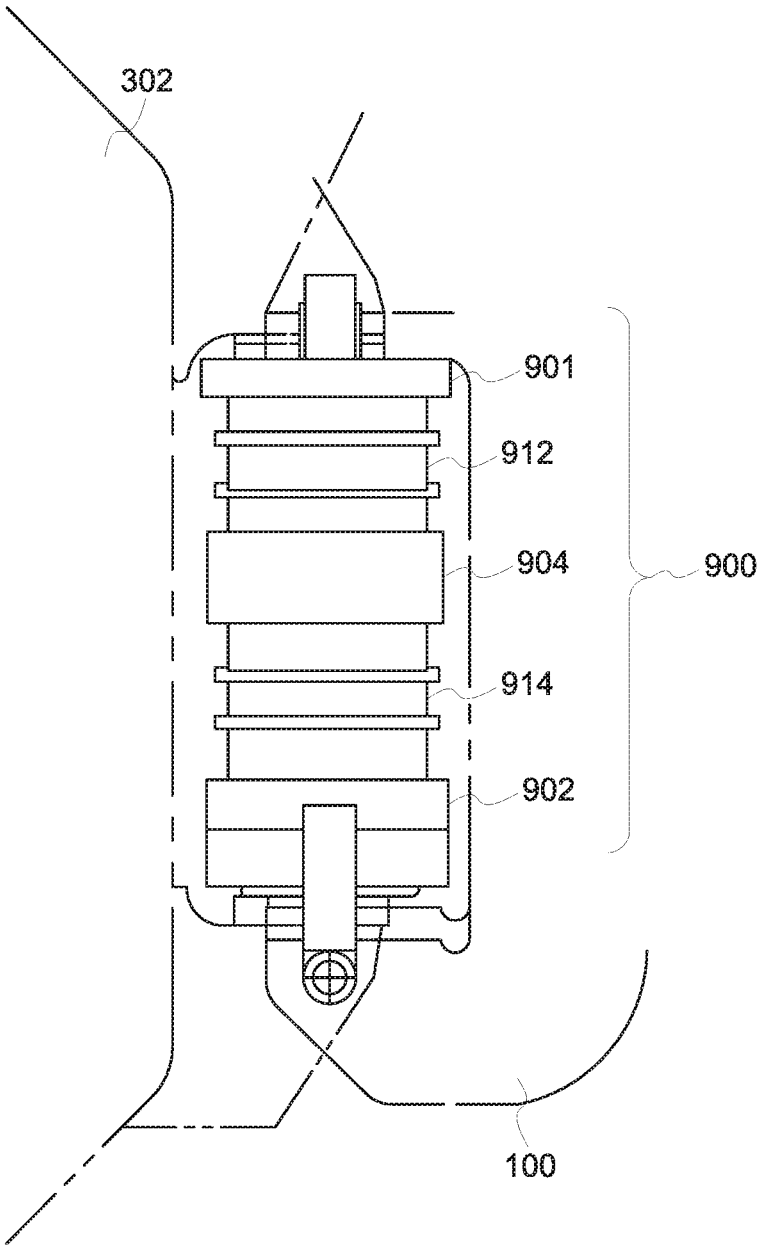
FIG. 16 illustrates a side view of the assembly shown in FIG. 14.
Figure 17:
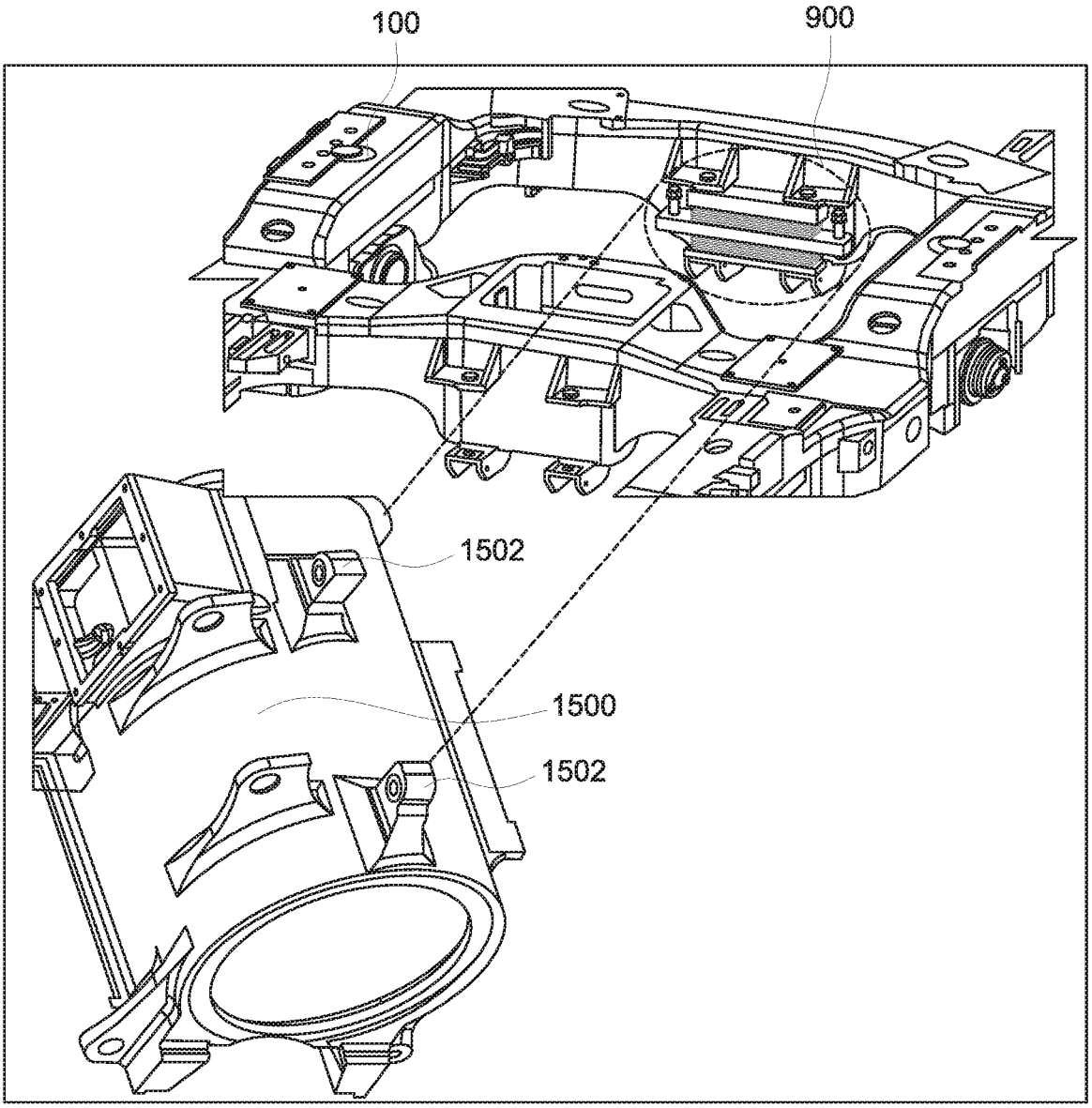
FIG. 17 illustrates an exploded view of an AC motor and vehicle frame according to one example.

FIG. 14 illustrates a front view of another example of a motor suspension assembly 900. FIG. 15 illustrates a cross-sectional view of the assembly 900 shown in FIG. 14. FIG. 16 illustrates a side view of the assembly 900 shown in FIG. 14. The assembly 900 can be used to retrofit the vehicle frame 100 from holding or otherwise supporting the DC motor 102 to holding or otherwise supporting an AC motor 1500, without removing portions of or modifying the shape of the frame 100. The assembly 900 can mount the AC motor 1500 to the frame 100 without use of the dog bone suspension links described above. The dog bone suspension links can provide support and stability to the connection between the AC motors and the frame 100 in vertical directions (e.g., directions that are perpendicular to and toward and away from the surface on which the vehicle having the frame 100 travels), but may not provide sufficient support or stability in other directions, such as lateral directions and/or forward and reverse directions of the vehicle having the frame 100. The assembly 900 provides increased support and stability (e.g., stiffness) in more directions than the dog bone suspension links, such as by providing increased stiffness in the connection between the AC motor and the frame 100 in lateral, vertical, and forward and reverse directions relative to the dog bone suspension links.

The assembly 900 includes upper and lower frame brackets 901, 902 and a suspension bracket 904. The suspension bracket 904 is located between the upper and lower frame brackets 901, 902. The brackets 901, 902, can be planar or flat bodies with openings or channels 906 through which bolts, screws, pins, or other fasteners can extend to couple the brackets 901, 902, to vehicle frame 100.

For example, the upper frame bracket 901 can include openings 906 through which bolts or pins can extend to secure the upper frame bracket 901 to the vehicle frame 100 in the same location that the upper suspension bar 108 previously was coupled for supporting the DC motor 102. The lower frame bracket 902 can include openings 906 through which bolts or pins can extend to secure the lower frame bracket 902 to the vehicle frame 100 in the same location that the lower suspension bar 110 previously was coupled.

Figure 18:
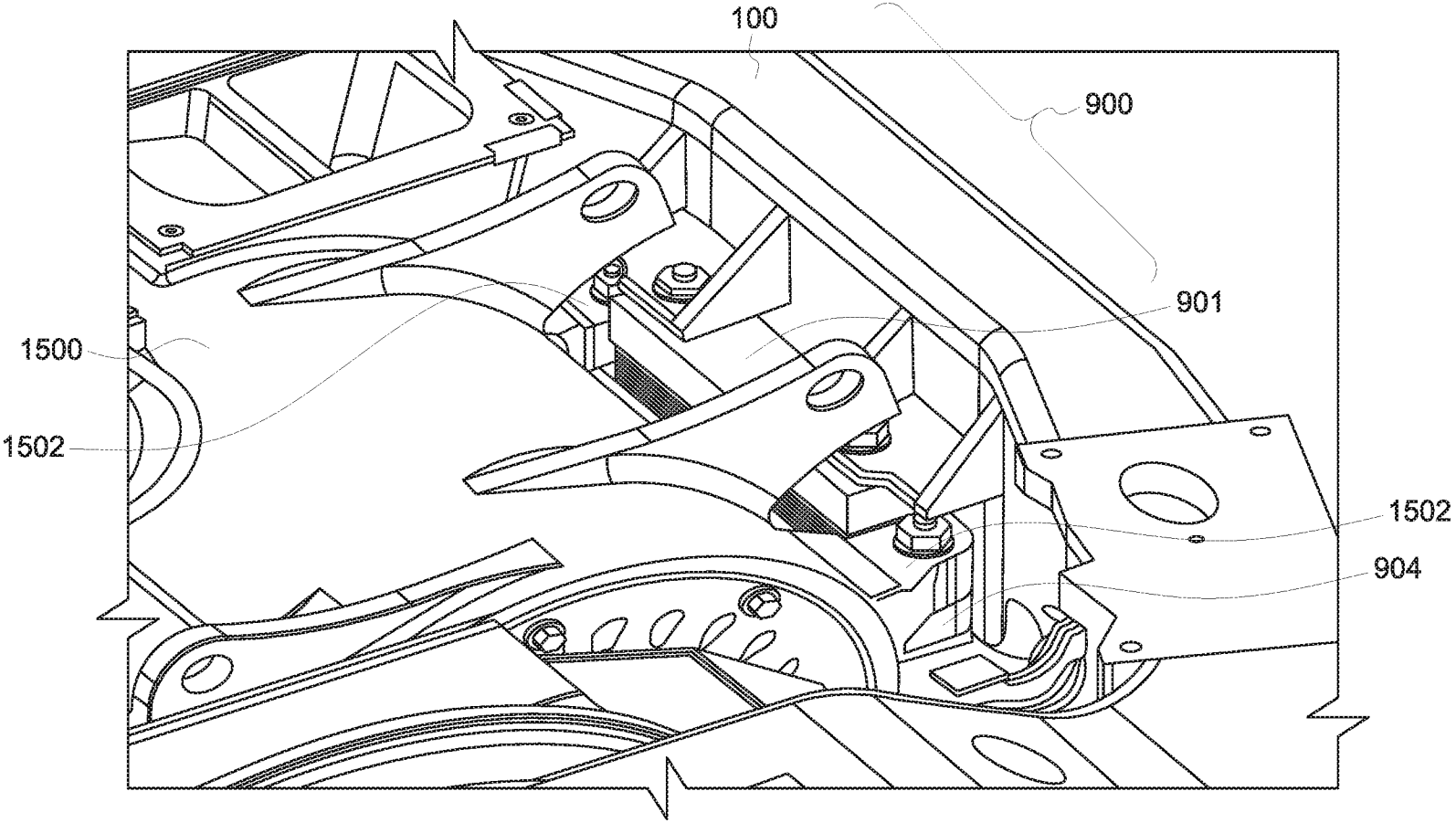
FIG. 18 illustrates a perspective view of the AC motor mounted to the vehicle frame using the assembly shown in FIGS. 14 through 16.

With continued reference to the suspension 900 as shown in FIGS. 14 through 16, FIG. 17 illustrates an exploded view of the AC motor 1500 and vehicle frame 100 according to one example, and FIG. 18 illustrates a perspective view of the AC motor 1500 mounted to the vehicle frame 100 using the assembly 900 shown in FIGS. 14 through 16. The suspension bracket 904 can include openings 906 at or near opposite lateral ends 908, 910 of the suspension bracket 904. These openings 906 in the suspension bracket 904 can receive bolts or other fasteners 1504 that couple nose brackets 1502 of the AC motor 1500 to the suspension bracket 904. The nose brackets 1502 can be part of the exterior housing of the AC motor 1500, or can be added to the AC motor 1500.

The assembly 900 includes one or more upper elastic pads 912 disposed between the upper frame bracket 901 and the suspension bracket 904. One or more lower elastic pads 914 of the assembly 900 are disposed between the suspension bracket 904 and the lower frame bracket 902. There are three pads 912 and three pads 914 in the illustrated embodiment, but there may be more or fewer pads 912 and/or pads 914. The elastic pads 912 and/or 914 can be flat in shape. For example, each of the opposite sides of each pad 912, 914 can be a planar side or surface. The flat pads 912, 914 can be disposed parallel to each other as shown in FIG. 14.

In the illustrated example, the assembly 900 also include plates 916, such as planar metal bodies, disposed between neighboring pairs of the upper elastic pads 912 and between neighboring pairs of the lower elastic pads 914. The elastic pads 912, 914 are pre-compressed between the frame brackets 901, 902. For example, the elastic pads 912, 914 can be planar rubber bodies or sheets that are compressed between the brackets 901, 904 or between the brackets 902, 904. The plates 916 also can compress the elastic pads 912, 914 between the corresponding brackets 901, 902, 904. The plates 916 and the pads 912 can be formed as a pre-assembled device with the pads 912 and the plates 916 (also referred to as shims) being coupled with each other by adhesive. Similarly, the plates 916 and pads 914 can be pre-assembled with each other by adhesive. The frame brackets 901, 902 and the suspension bracket 904 also can function as metal shims, similar to the plates 916. The entire assembly 900 provides the stiffness needed in several or all directions (in both translational and rotational directions) between the suspension bracket 904 and the frame brackets 901, 902. As the frame brackets 901, 902 will be fixed on the frame 100, and the suspension bracket 904 will be fixed on the nose 1502 of the motor 1500, the stiffness of the rubber-metal sandwich assemblies formed by the plates 916 and pads 912, 914 also will provide stiffness between the motor 1500 and the frame 100 of the vehicle.

As shown in FIG. 14, the AC motor 1500 is mounted to the assembly 900 in locations that are outside of the pads 912, 914. The nose brackets 1502 of the AC motor 1500 can be located on either side of the elastic pads 912, 914 and be coupled with the suspension bracket 904 outside of the locations of the elastic pads 912, 914.

The suspension assembly 900 can be pre-compressed and completely fill the gap or space between the upper and lower brackets of the vehicle frame 100 (e.g., the locations where the upper and lower suspension bars 108, 110 previously were coupled with the frame 100). The pre-compressed suspension assembly 900 and the arrangement that the elastic pads 912, 914 are distributed on both sides of the suspension bracket 904 can eliminate the dead zone of the suspension stiffness characteristics between the frame brackets 901, 902 (or vehicle frame 100) and the suspension bracket 904 (or motor 1500) which is caused by motor gravity and reactions to torque direction changes of the AC motor 1500 and was an issue in the DC motor suspension 112. A proper combination of the pads 912, 914 and plates 916 can provide the required stiffness between the AC motor 1500 and the vehicle frame 100 to reduce and absorb vibrations generated during movement of the vehicle that includes the AC motor 1500 and/or during operation of the AC motor 1500.

Figure 19:
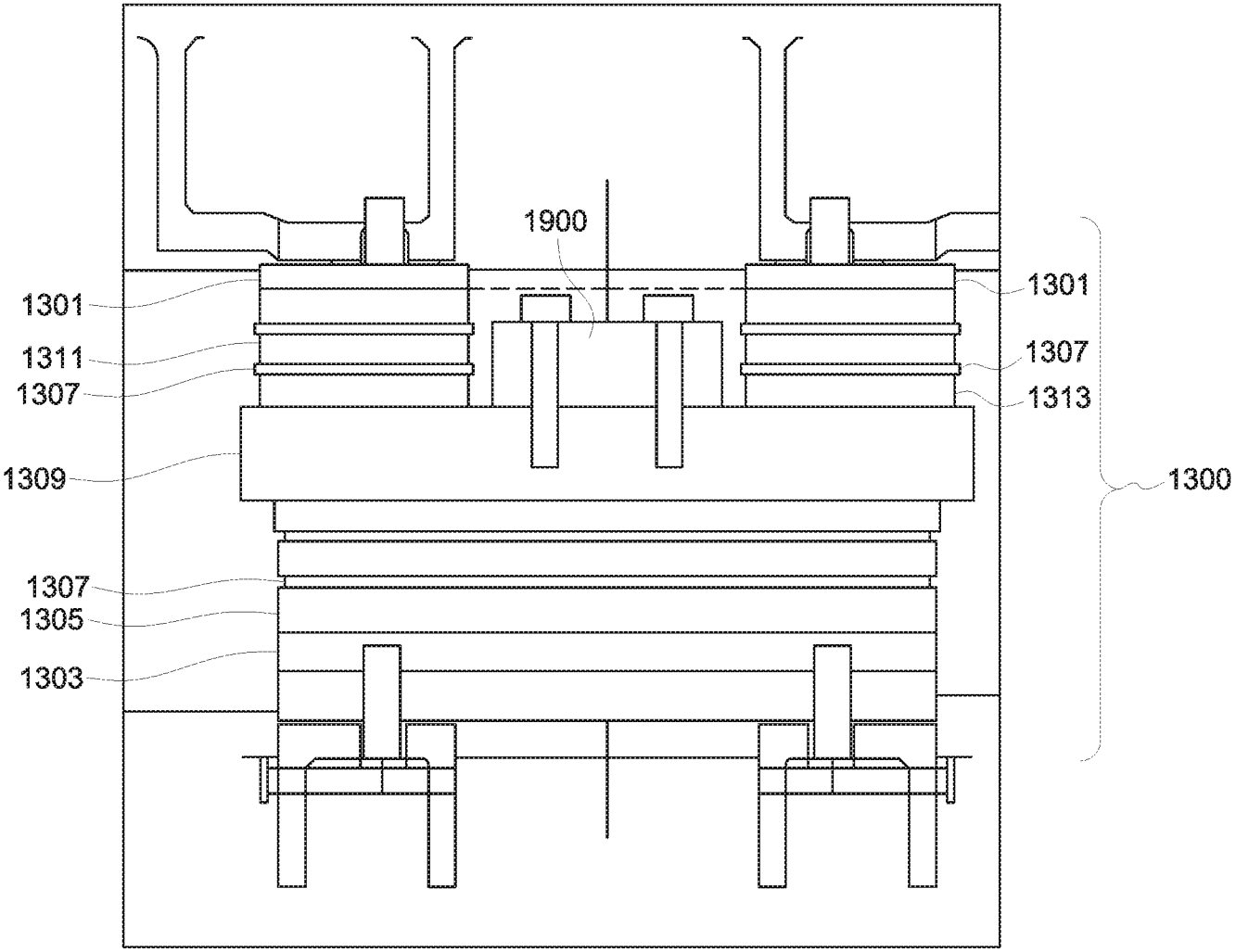
FIG. 19 illustrates another example of a motor suspension assembly.

FIG. 19 illustrates another example of a motor suspension assembly 1300. The assembly 1300 is similar to the assembly 900 shown in FIGS. 14 through 18 in that the assembly 1300 includes upper and lower frame brackets 1301, 1303, lower elastic pads 1305, and (optionally) plates 1307. The assembly 1300 also includes a suspension bracket 1309 and upper elastic pads 1311, 1313 in the assembly 1300 and the location where a nose bracket or brackets 1900 of an AC motor attach to the assembly 1300.

As shown in FIG. 19, the upper frame bracket 1301 is separated into right and left portions, and the upper elastic pads 1311, 1313 in the assembly 1300 are separated into left elastic pads 1311 and right elastic pads 1313. The bracket 1301 and the elastic pads 1311, 1313 are laterally spaced apart from each other to provide space or a gap for the nose bracket 1900 of the AC motor to couple with the suspension bracket 1309. The nose bracket 1900 of the AC motor may be modified or repositioned so that the nose bracket 1900 is more centrally located on the outer housing of the AC motor. The upper elastic pads 1311, 1313 are smaller than the upper elastic pads 912 to provide for the space for the nose bracket 1900 of the AC motor. The plates 1307 between the upper elastic pads 1311, 1313 also can be smaller to provide for this gap. The assembly 1300 can be used to mount the AC motor in situations where the nose bracket or brackets 1900 of the AC motor are not positioned for coupling with the suspension bracket 1309 outside of the upper elastic pads 912 in the assembly 900.

The elastic pads in the assemblies 900, 1300 are flat or planar bodies that provide stiffness to the connection between the AC motor and the frame 100, and that also reduce and absorb at least some vibrations of the AC motor and/or due to movement of the vehicle that includes the frame 100 and the AC motor.

Figure 20:
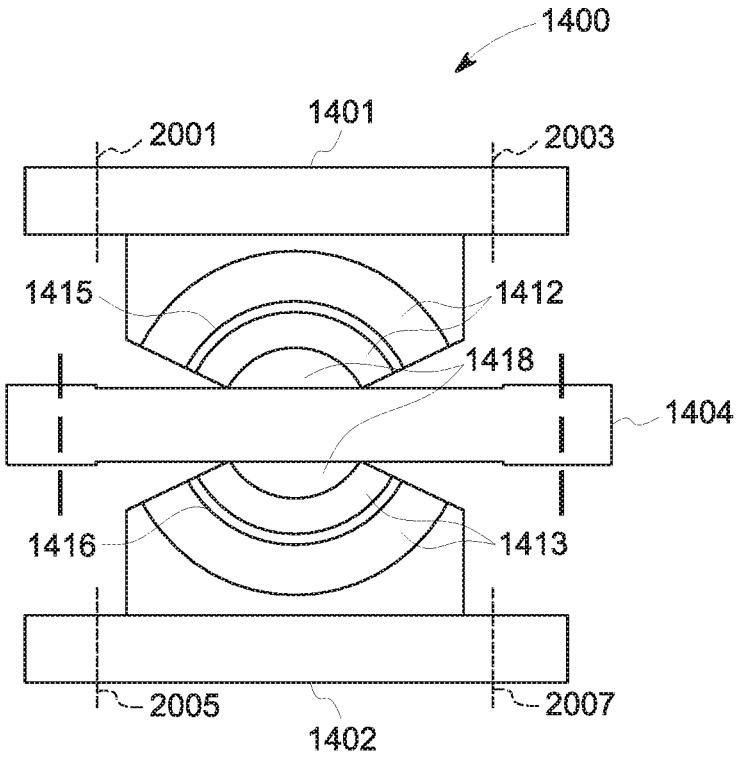
FIG. 20 illustrates another example of a motor suspension assembly.

FIG. 20 illustrates another example of a motor suspension assembly 1400. The assembly 1400 is similar to the assemblies 900, 1300 in that the assembly 1400 includes upper and lower frame brackets 1401, 1402 that couple to the frame 100 in locations 2001, 2003, 2005, 2007 where the upper and lower suspension bars 108, 110 were coupled, a suspension bracket 1404 that couples with the nose brackets 1502 of the AC motor 1500, one or more curved upper elastic pads 1412 disposed between the upper frame bracket 1401 and the suspension bracket 1404, one or more curved lower elastic pads 1413 disposed between the lower frame bracket 1402 and the suspension bracket 1404, optionally one or more curved plates 1415 disposed between the upper elastic pads 1412, and optionally one or more curved plates 1416 between the lower elastic pads 1414.

One difference between the assembly 1400 and the assemblies 900, 1300 is the curved shapes of the components. The elastic pads 1412, 1412 have convex shapes that curve outwardly and away from the suspension bracket 404. The suspension bracket 1404 includes rounded protrusions 1418, such as semi-spherical projections, that outwardly extend from the main body of the suspension bracket 1404 toward the upper and lower frame brackets 1401, 1402. These protrusions 1418 are received into concave openings or recesses formed by the curved arcuate shape of the upper and lower elastic pads 1412, 1413, as shown in FIG. 20. The optional plates 1415, 1416 can have a curved shape that is complementary to the curved shapes of the elastic pads 1412, 1413 so that the plates 1415, 1416 fit between and engage the elastic pads 1412, 1413. The upper and lower frame brackets 1401, 1402 also include concave recesses to receive the curved elastic pads 1412, 1413. The pads 1412, 1413 and corresponding plates 1415, 1416 can be pre-assembled and coupled with each other by adhesives. In one embodiment, all components shown in FIG. 20 can be bound together by adhesives.

The curved shapes of the components in the assembly 1400 can allow for the assembly 1400 to better comply the twisting movements or vibrations of the AC motor 1500 than one or more other assemblies 900, 1300. When the assembly 1400 is compressed between the upper and lower brackets of the frame 100, it can provide similar vertical stiffness as the assemblies 900, 1300, but smaller or reduced lateral and twisting stiffness when compared with the assemblies 900, 1300. For example, twisting movement or vibration of the AC motor 1500 can occur when the right (or left) nose bracket 1502 moves up or down more than the left (or right) nose bracket 1502 of the AC motor 1500. The curved shapes of the components in the assembly 1400 can allow for this twisting movement or vibration to be absorbed by the elastic pads 1412, 1413 without incurring or inducing a backlash of the twisting movement or vibration. For example, the gaps between the curved elastic pads 1412, 1413 and the outer ends of the suspension bracket 1404 can allow for some twisting movement to occur and be dampened without reflecting the energy of the twisting movement back into the AC motor 1500.

Figure 21:
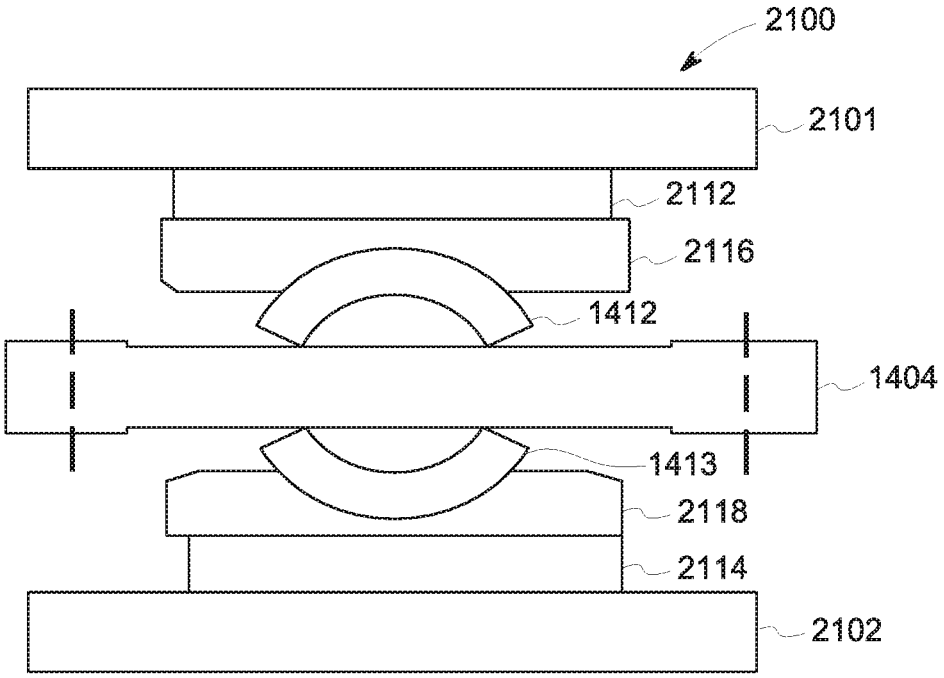
FIG. 21 illustrates another example of a motor suspension assembly.

FIG. 21 illustrates another example of a motor suspension assembly 2100. The assembly 2100 is similar to the assemblies 900, 1300, 1400 in that the assembly 2100 includes upper and lower frame brackets 2101, 2102 that couple to the frame 100 in locations where the upper and lower suspension bars 108, 110 were coupled, the suspension bracket 1404 that couples with the nose brackets 1502 of the AC motor 1500, one or more upper elastic pads 1412 disposed between the upper frame bracket 2101 and the suspension bracket 1404, one or more lower elastic pads 1413 disposed between the lower support bracket 2102 and the suspension bracket 1404.

One difference between the assembly 2100 and the assembly 1400 is the inclusion of thicker plates 2116, 2118 in the assembly 2100, both curved and planar upper elastic pads 1412, and both curved and planar lower elastic pads 1414. The plates 2116, 2118 can be metal plates that have concave recesses. The curved elastic pads 1412, 1413 can be received into these recesses, as shown in FIG. 21. The opposite sides of the plates 2116, 2118 can be flat or planar, and can engage the corresponding upper or lower flat elastic pads 2112, 2114.

The curved shapes of the components in the assembly 2100 can allow for the assembly 2100 to better comply with twisting movements or vibrations of the AC motor 1500 than one or more other assemblies 900, 1300 by lowering lateral and twisting stiffness. The curved shapes of the components in the assembly 2100 can allow for this twisting movement or vibration to be absorbed by the elastic pads without incurring or inducing a backlash of the twisting movement or vibration.

Figure 22:
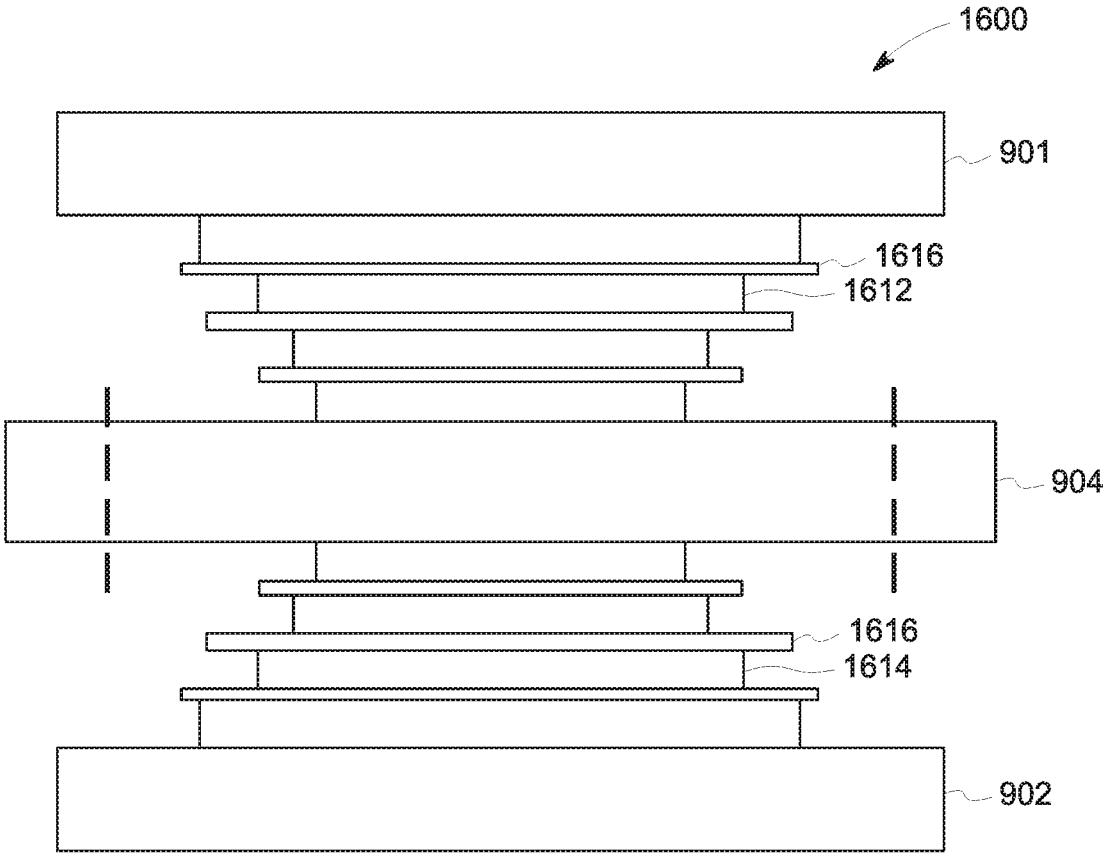
FIG. 22 illustrates another example of a motor suspension assembly.

FIG. 22 illustrates another example of a motor suspension assembly 1600. The assembly 1600 is similar to the assembly 900 in that the assembly 1600 includes upper and lower frame brackets 901, 902 that couple to the frame 100 in locations where the upper and lower suspension bars 108, 110 were coupled, and the suspension bracket 904 that couples with the nose brackets 1502 of the AC motor 1500.

One difference between the assembly 1600 and the assembly 900 is the different sized elastic pads above and below the suspension bracket 904. The assembly 1600 includes upper elastic pads 1612 between the suspension bracket 904 and the upper frame bracket 901 and lower elastic pads 1614 between the suspension bracket 904 and the lower frame bracket 902. The pads 1612, 1614 have different sizes in that the upper elastic pads 1612 increase in lateral size from the pad 1612 closest to the suspension bracket 904 to the pad closest to the upper frame bracket 901, and the lower elastic pads 1614 increase in lateral size from the pad 1614 closest to the suspension bracket 904 to the pad closest to the lower frame bracket 902. For example, the elastic pads 1612, 1614 increase in lateral sizes for those pads 1612, 1614 that are farther from the suspension bracket 904. Optionally, plates 1616 are provided between the pads 1612, 1614, with the plates 1616 also having different lateral sizes, as shown in FIG. 22.

The increasing sizes of the pads 1612, 1614 can allow for the assembly 1600 to better comply twisting movements or vibrations of the AC motor 1500 than one or more other assemblies 900, 1300 by providing lower lateral and twisting stiffness. The assembly 1600 also may provide better stability relative to the assemblies 1400, 1500. The increasing sizes of the pads 1612, 1614 can allow for this twisting movement or vibration to be reduced and absorbed by the elastic pads 1612, 1614 without incurring or inducing a backlash of the twisting movement or vibration.

Figure 23:
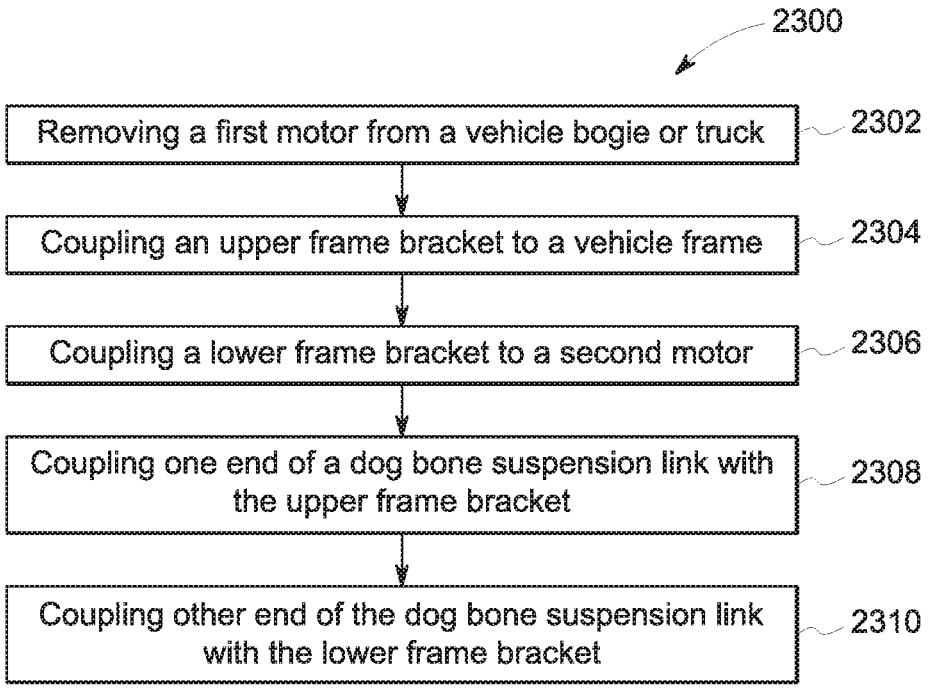
FIG. 23 illustrates one embodiment of a flowchart of a method for replacing an engine of a vehicle.

FIG. 23 illustrates one embodiment of a flowchart of a method 2300 for replacing an engine of a vehicle. The method 2300 can be used to retrofit a vehicle (e.g., rail vehicle) bogie or truck. For example, the method 2300 can be performed to replace a DC motor of a vehicle with an AC motor. The frame does not have to be modified for retrofitting with the AC motor. The frame may not be modified when the frame is not cut, bent, or otherwise changed (although one or more components can be added to the frame during the retrofitting process).

At 2302, a first motor is removed. The first motor can be a DC motor in the vehicle bogie or truck. This motor can be unbolted or otherwise detached from the bogie or truck. At 2304, an upper frame bracket is coupled with a frame of the bogie or truck. For example, the upper frame bracket 803 can be connected with the vehicle frame 100 by bolting or otherwise fastening the upper frame bracket 803 to the frame 100. The upper frame bracket 803 can include the holes 502 that receive bolts, screws, pins, or the like, for securely coupling the upper frame bracket 803 to the vehicle frame 100. The upper frame bracket 803 can be coupled with the vehicle frame 100 in the same mounting location that an upper suspension bar 108 previously was coupled with the vehicle frame 100 for supporting the first motor.

At 2306, a lower frame bracket is coupled to a second motor. For example, the lower frame bracket 809 can be bolted to the nose bracket 811 of the AC motor. The nose bracket 811 can be an elongated linear or planar extension of the housing of the AC motor or can be an elongated linear or planar extension that is added to the housing of the AC motor (e.g., by bolting or welding the extension onto the housing). Bolts, screws, pins, or other fasteners can be placed through openings 502 in the lower frame bracket 809 and secured to the arms of the nose bracket 811.

At 2308, one end of a dog bone suspension link is coupled with the upper frame bracket. For example, the upper end 805 of the dog bone suspension link 807 can be coupled with the upper frame bracket 803 by a pre-compressed elastic bush or bushings 701. The upper frame bracket 803 can be inserted through the upper opening 408 in the upper end of the dog bone suspension link 807 such that the dog bone suspension link 807 can at least move and rotate relative to the upper frame bracket 803 by using the elastic bush 701. Optionally, the dog bone suspension link can be coupled with the upper frame bracket before the upper frame bracket is coupled with the frame.

At 2310, the other end of the dog bone suspension link is coupled with the lower frame bracket. The lower frame bracket 809 can be coupled with the lower end of the dog bone suspension link 807 by the pre-compressed elastic bush 701. The lower frame bracket 809 can be located in a lower opening or channel 409 that extends through the lower end of the elongated body of the dog bone suspension link 807. Optionally, the lower end of the dog bone suspension link 807 can be coupled with the lower frame bracket 809 before the lower frame bracket 809 is coupled with the frame 100.

The upper and lower frame brackets 803, 809 and the nose bracket 811 connect the AC motor with the vehicle frame 100 such that the AC motor is suspended to the vehicle frame 100 without removing parts of or otherwise changing the shape or layout of the vehicle frame 100. The elastic bushes 701 can allow the motor to move and rotate relative to the vehicle frame 100 and provide the suspension stiffness to reduce and absorb vibrations generated during operation of the vehicle and the AC motor. The AC motor also can be connected with an axle of the vehicle directly or via one or more gears. The AC motor may not have any other connection or coupling with the vehicle frame 100 (aside from the assembly 400) in one embodiment.

Figure 24:
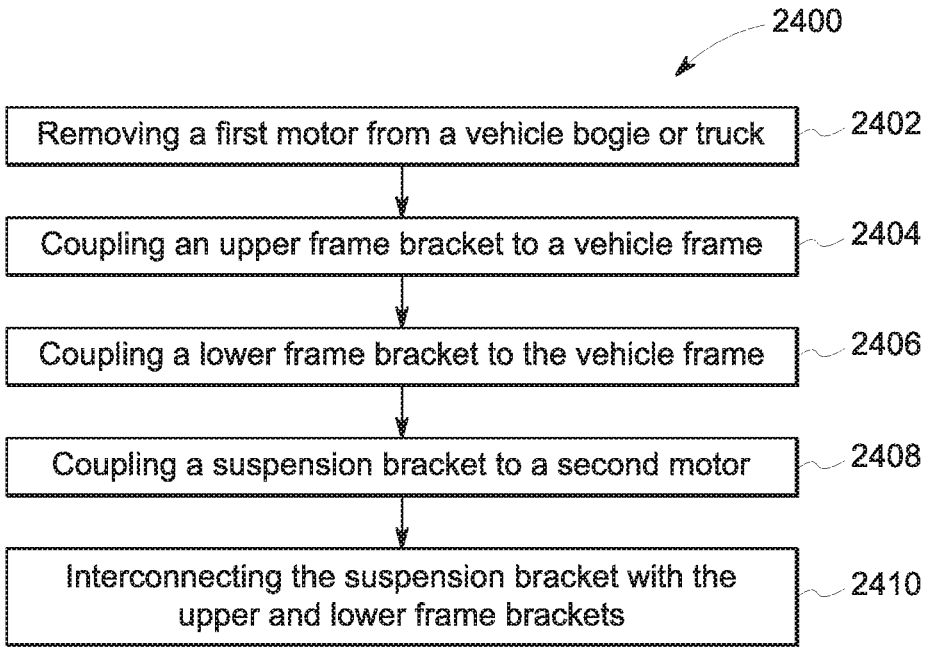
FIG. 24 illustrates another embodiment of a flowchart of a method for replacing an engine of a vehicle.

FIG. 24 illustrates another embodiment of a flowchart of a method 2400 for replacing an engine of a vehicle. The method 2400 also can be used to retrofit a vehicle (e.g., rail vehicle) bogie or truck. For example, the method 2400 can be performed to replace a DC motor of a vehicle with an AC motor. The frame does not have to be modified for retrofitting with the AC motor. The frame may not be modified when the frame is not cut, bent, or otherwise changed (although one or more components can be added to the frame during the retrofitting process).

At 2402, a first motor is removed. The first motor can be a DC motor in the vehicle bogie or truck. This motor can be unbolted or otherwise detached from the bogie or truck. At 2404, an upper frame bracket is coupled with a frame of the bogie or truck. For example, the upper frame bracket 901 can be coupled with the vehicle frame by inserting fasteners through the openings 906 in the bracket 901. At 2406, a lower frame bracket is coupled with the vehicle frame. For example, the lower frame bracket 902 can be coupled with the vehicle frame by inserting fasteners through the openings 906 in the lower frame bracket 902.

At 2408, a suspension bracket is coupled with a second motor. For example, the suspension bracket 904 can be coupled with the nose bracket or brackets 1502 of an AC motor, with fasteners inserted through openings in the suspension bracket and the nose brackets to secure the suspension and nose brackets together. At 2410, the suspension bracket is interconnected with the upper and lower frame brackets by one or more elastic bodies and/or rigid plates. For example, the suspension bracket 904 can be positioned between the upper and lower frame brackets 901, 902. A stack of elastic pads 912 and/or rigid plates 916 can be positioned between the suspension bracket 904 and the upper frame bracket 901, and another stack of elastic pads 914 and/or rigid plates 916 can be positioned between the suspension bracket 904 and the lower frame bracket 902. The elastic pads 912, 914 can be compressed between the brackets 901, 904 or between the brackets 902, 904. The plates 916 also can compress the elastic pads 912, 914 between the corresponding brackets 901, 902, 904.

In one embodiment, a method includes coupling a frame bracket with a vehicle frame in a location where an upper suspension bar or a lower suspension bar previously was coupled with the vehicle frame. The upper and lower suspension bars previously held one or more elastic pads therebetween and positioned for a DC traction motor to rest on the upper suspension bar. The method also includes coupling a frame bracket of the dog bone suspension with a nose bracket of an AC traction motor. The method also includes coupling the dog bone suspension link with the frame brackets where the pre-compressed elastic bushes between the dog bone suspension link and the frame brackets provide elastic connection to allow relative movement and rotation between the AC motor and the vehicle frame to reduce and absorb vibration during operation of the vehicle and AC traction motor.

Optionally, the method also can include removing the one or more elastic pads disposed between the upper and lower suspension bars connected with the vehicle frame.

Optionally, the method also can include disconnecting the upper and lower suspension bars from the vehicle frame.

Optionally, the frame bracket of the dog-bone suspension is coupled with the vehicle frame in place of the upper suspension bar.

Optionally, coupling the dog bone suspension includes coupling an opposite lower end frame bracket of the dog bone suspension with the nose bracket.

Optionally, the frame bracket is coupled with the vehicle frame in place of the lower suspension bar.

Optionally, coupling the dog bone suspension includes coupling an opposite upper end frame bracket of the dog bone suspension with the nose bracket.

In one embodiment, a method includes coupling an upper frame bracket with a vehicle frame having mounting locations for upper and lower suspension bars that are positioned for a DC traction motor to rest upon the upper suspension bar. The upper frame bracket is configured to be coupled with the vehicle frame in place of the upper suspension bar. The method also includes coupling a lower frame bracket with the vehicle frame in place of the lower suspension bar, and coupling a suspension bracket with a nose bracket of an alternating current (AC) traction motor. The method also includes positioning one or more upper elastic pads between the upper frame bracket and the suspension bracket, and positioning one or more lower elastic pads between the lower frame bracket and the suspension bracket. The one or more upper elastic pads and the one or more lower elastic pads fill open spaces between upper frame bracket, the lower frame bracket, and the suspension bracket to absorb vibration during operation of the AC traction motor.

Optionally, the one or more upper elastic pads are laterally separated into one or more left upper elastic pads and one or more right upper elastic pads with the one or more left upper elastic pads laterally spaced apart from the one or more right upper elastic pads.

Optionally, the suspension bracket is coupled with the nose bracket of the AC traction motor in a location between the one or more left upper elastic pads and the one or more right upper elastic pads.

Optionally, the nose bracket of the AC traction motor includes a left bracket portion and a right bracket portion that are laterally spaced apart from each other, and the suspension bracket is coupled with the left and right bracket portions of the nose bracket in locations that are laterally outside of the one or more upper elastic pads such that the one or more upper elastic pads are located between the left and right bracket portions of the nose bracket.

In an embodiment, a truck or bogie for a vehicle (e.g., locomotive or other rail vehicle) includes a frame, a first frame bracket, a second frame bracket, an AC traction motor, plural pre-compressed elastic bushes, and a dog bone suspension link. The first frame bracket is coupled with the frame. The second frame bracket is coupled with a nose bracket of the AC traction motor. The dog bone suspension link is coupled with the first and second frame brackets by the pre-compressed elastic bushes. The pre-compressed elastic bushes are positioned between the dog bone suspension link and the first and second brackets for coupling the dog bone suspension link with the first and second frame brackets, and are configured to provide suspension stiffness to reduce and absorb vibration during operation of the vehicle and the AC traction motor. The bogie may also include one or more axles, one or more wheels connected to the one or more axles (e.g., two wheels per axle), and a gear assembly that connects the motor to the axle, so that operation of the motor causes the axle and wheels attached to the axle to turn.

In an embodiment, a bogie or truck for a vehicle (e.g., a locomotive or other rail vehicle) includes a frame, and an upper frame bracket coupled with the frame. The bogie also includes a lower frame bracket coupled with the frame. The bogie also includes an AC traction motor with a nose bracket. The bogie also includes a suspension bracket coupled with the nose bracket of the AC motor. One or more upper elastic pads separated by metal plates are compressed between the upper frame bracket and the suspension bracket. One or more lower elastic pads separated by metal plates are compressed between the lower frame bracket and the suspension bracket. The one or more upper elastic pads and the one or more lower elastic pads are pre-compressed to fill open spaces between the upper frame bracket, the lower frame bracket, and the suspension bracket to provide suspension stiffness without a dead zone to reduce and absorb vibration during operation of vehicle and the AC traction motor. The bogie may also include one or more axles, one or more wheels connected to the one or more axles (e.g., two wheels per axle), and a gear assembly that connects the motor to the axle, so that operation of the motor causes the axle and wheels attached to the axle to turn.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. An assembly comprising:

a first frame bracket configured to be coupled with a vehicle frame of a vehicle, the vehicle frame having mounting locations configured to receive upper and lower suspension bars that are positionable on the vehicle frame for a direct current (DC) traction motor to rest upon the upper suspension bar and for elastic pads to be disposed between the upper and lower suspension bars, wherein the first frame bracket is configured to be coupled with the vehicle frame in place of at least one of the upper suspension bar or the lower suspension bar;

a second frame bracket configured to be coupled with a nose bracket of an alternating current (AC) traction motor; and plural pre-compressed elastic bushes, and a dog bone suspension link configured to be coupled with the first and second frame brackets by the pre-compressed elastic bushes, wherein the pre-compressed elastic bushes, when positioned between the dog bone suspension link and the first and second brackets for coupling the dog bone suspension link with the first and second frame brackets, are configured to provide suspension stiffness to reduce and absorb vibration during operation of the vehicle and the AC traction motor.

2. The assembly of claim 1, wherein the first frame bracket is configured to be coupled with the vehicle frame in place of the upper suspension bar.

3. The assembly of claim 2, wherein the dog bone suspension link is elongated between opposite upper and lower ends with the upper end of the dog bone suspension link configured to be coupled with the first frame bracket and the lower end of the dog bone suspension link configured to be coupled with the nose bracket of the AC traction motor.

4. The assembly of claim 1, wherein the first frame bracket is configured to be coupled with the vehicle frame in place of the lower suspension bar.

5. The assembly of claim 4, wherein the dog bone suspension link is elongated between opposite upper and lower ends with the lower end of the dog bone suspension link configured to be coupled with the first frame bracket and the upper end of the dog bone suspension link configured to be coupled with the nose bracket of the AC traction motor.

6. A bogie comprising:

the assembly of claim 1, wherein the first frame bracket is coupled with the vehicle frame of the vehicle in place of one of the upper suspension bar or the lower suspension bar;

the second frame bracket is coupled with the nose bracket of the AC traction motor and is coupled with the vehicle frame in place of the other one of the upper suspension bar or the lower suspension bar; and the dog bone suspension link is coupled with the first and second frame brackets by the pre-compressed elastic bushes, the bushes positioned between the dog bone suspension link and the first and second frame brackets.

7. An assembly comprising:

an upper frame bracket configured to be coupled with a vehicle frame of a vehicle, the vehicle frame having mounting locations for upper and lower suspension bars that are positionable for a direct current (DC) traction motor to rest upon the upper suspension bar, the upper frame bracket configured to be coupled with the vehicle frame in place of the upper suspension bar;

a lower frame bracket configured to be coupled with the vehicle frame in place of the lower suspension bar;

a suspension bracket configured to be coupled with a nose bracket of an alternating current (AC) traction motor;

one or more upper elastic pads separated by metal plates and configured to be compressed between the upper frame bracket and the suspension bracket; and one or more lower elastic pads separated by metal plates and configured to be compressed between the lower frame bracket and the suspension bracket, wherein the one or more upper elastic pads and the one or more lower elastic pads are pre-compressed to fill open spaces between the upper frame bracket, the lower frame bracket, and the suspension bracket to provide suspension stiffness without a dead zone to reduce and absorb vibration during operation of vehicle and the AC traction motor.

8. The assembly of claim 7, wherein the one or more upper elastic pads are laterally separated into one or more left upper elastic pads and one or more right upper elastic pads with the one or more left upper elastic pads laterally spaced apart from the one or more right upper elastic pads.

9. The assembly of claim 7, wherein the nose bracket of the AC traction motor includes a left bracket portion and a right bracket portion that are laterally spaced apart from each other, and wherein the suspension bracket is configured to be coupled with the left and right bracket portions of the nose bracket in locations that are laterally outside of the one or more upper elastic pads such that the one or more upper elastic pads are located between the left and right bracket portions of the nose bracket.

10. The assembly of claim 7, wherein the one or more upper elastic pads have a flat shape and the one or more lower elastic pads have a flat shape.

11. The assembly of claim 7, wherein the one or more upper elastic pads have a curved arcuate shape and the one or more lower elastic pads have a curved arcuate shape.

12. The assembly of claim 7, wherein the one or more upper elastic pads include plural upper elastic pads having different lateral sizes.

13. The assembly of claim 7, wherein the one or more lower elastic pads include plural lower elastic pads having different lateral sizes.

14. The assembly of claim 13, wherein the lower elastic pads that are closer to the suspension bracket have smaller lateral sizes than the lower elastic pads that are farther from the suspension bracket.

15. A bogie comprising:

the assembly of claim 7, wherein the upper frame bracket is coupled with the vehicle frame in place of the upper suspension bar;

the lower frame bracket is coupled with the vehicle frame in place of the lower suspension bar;

the suspension bracket is coupled with the nose bracket of the AC traction motor;

the one or more upper elastic pads are compressed between the upper frame bracket and the suspension bracket; and the one or more lower elastic pads are compressed between the lower frame bracket and the suspension bracket.

16. A method comprising:

coupling a dog bone suspension link with upper and lower frame brackets by pre-compressed elastic bushes, wherein the pre-compressed elastic bushes between the dog bone suspension link and the frame brackets are configured to provide suspension stiffness to reduce and absorb vibration during operation of a vehicle and an alternating current (AC) traction motor;

coupling one of the upper and lower frame brackets with a vehicle frame in a location where an upper suspension bar or a lower suspension bar previously was coupled with the vehicle frame, the upper and lower suspension bars previously holding one or more elastic pads therebetween and positioned for a direct current (DC) traction motor to rest on the upper suspension bar; and coupling another one of the upper and lower frame brackets with a nose bracket of the AC traction motor.

17. The method of claim 16, further comprising removing the one or more elastic pads disposed between the upper and lower suspension bars connected with the vehicle frame.

18. The method of claim 16, further comprising disconnecting the upper and lower suspension bars from the vehicle frame.

19. The method of claim 16, wherein the upper frame bracket is coupled with the vehicle frame in place of the upper suspension bar.

20. The method of claim 19, wherein coupling the dog bone suspension includes coupling the lower frame bracket of the opposite lower end of the dog bone suspension with the nose bracket.

21. The method of claim 16, wherein the lower frame bracket is coupled with the vehicle frame in place of the lower suspension bar.

22. The method of claim 21, wherein coupling the dog bone suspension includes coupling the upper frame bracket of the opposite upper end of the dog bone suspension with the nose bracket.

* * * * *